US011655999B2

(12) United States Patent
Davtyan et al.

(10) Patent No.: US 11,655,999 B2
(45) Date of Patent: May 23, 2023

(54) ENVIRONMENTAL CONTROL UNIT

(71) Applicant: Robert Bosch GmbH, Stuttgart (DE)

(72) Inventors: Armen Davtyan, Ashland, MA (US); Aya Kozono, Watertown, MA (US)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 154 days.

(21) Appl. No.: 17/354,406

(22) Filed: Jun. 22, 2021

(65) Prior Publication Data

US 2021/0396425 A1 Dec. 23, 2021

Related U.S. Application Data

(60) Provisional application No. 63/042,391, filed on Jun. 22, 2020.

(51) Int. Cl.

| | |
|---|---|
| ***F25D 17/06*** | (2006.01) |
| ***F24F 13/20*** | (2006.01) |
| ***F24F 3/00*** | (2006.01) |
| *F24F 5/00* | (2006.01) |

(52) U.S. Cl.

CPC ..... *F24F 13/20* (2013.01); *F24F 3/001* (2013.01); *F24F 5/0003* (2013.01)

(58) Field of Classification Search

CPC ..... F24F 2013/205; F24F 2013/202; F24F 5/0003; F24F 3/001; F24F 13/20

USPC ..... 62/426

See application file for complete search history.

(56) References Cited

U.S. PATENT DOCUMENTS

| | | | | |
|---|---|---|---|---|
| 3,888,090 | A * | 6/1975 | Meyer | F24F 13/224 62/426 |
| 5,983,888 | A * | 11/1999 | Anselmino | F04D 29/664 454/67 |
| 6,109,339 | A * | 8/2000 | Talbert | F24F 5/0096 454/243 |
| 6,668,970 | B1 * | 12/2003 | Lee | F24F 13/24 181/224 |
| 10,254,006 | B2 * | 4/2019 | Hong | F24F 1/12 |
| 2006/0053819 | A1 * | 3/2006 | Wu | B01D 53/265 62/93 |
| 2008/0087030 | A1 * | 4/2008 | Park | F01C 21/02 62/175 |
| 2010/0071393 | A1 * | 3/2010 | Tatton | F28D 1/0477 62/434 |

(Continued)

*Primary Examiner* — Claire E Rojohn, III

(74) *Attorney, Agent, or Firm* — Kelly McGlashen

(57) ABSTRACT

An environmental control unit, such as an HVAC or heat pump unit, includes a housing which contains four main components: a blower which draws air into the housing via an air inlet and exhausts air from the housing via an air outlet; a first heat exchanger that exchanges heat through the air and is located between the air inlet and the blower; a second heat exchanger, which exchanges heat through water and is disposed in the second area of the housing; and a compressor. The environmental control unit having a predetermined set of parts can be arranged in multiple configurations to meet installation requirements, where configurations include air entering from the left side or, alternatively, from the right of the environmental control unit. The configurations utilize the same parts and provide front-facing access to fluid connections and the control board.

23 Claims, 35 Drawing Sheets

(56) References Cited

U.S. PATENT DOCUMENTS

| | | | | |
|---|---|---|---|---|
| 2017/0276395 | A1* | 9/2017 | Nyhof | F24F 1/005 |
| 2020/0224922 | A1* | 7/2020 | Spors | G01K 1/08 |

* cited by examiner

ENVIRONMENTAL CONTROL UNIT

BACKGROUND

Environmental control units such as HVAC or heat pump units are used in many heating and cooling applications to control the environment within a closed space. Some conventional heat pumps, for example, include a condensing heat exchanger and an evaporating heat exchanger disposed in a cabinet along with a compressor and a blower that is configured to draw air through the heat exchangers. Heating or cooling equipment such as an HVAC or heat pinup units employing a compressor and/or blower are complex devices having hundreds of parts. Moreover, such heating or cooling equipment is typically offered for sale in multiple configurations. For example, the same heat pump unit may be offered for sale in a first configuration in which the air return is on a first side of the heat pump unit, and in a second configuration in which the air return is on a second side of the heat pump unit. A consequence of offering for sale in multiple configurations is that the number of parts needed to manufacture the heat pump unit increases for each offered configuration.

It is desirable to provide heating or cooling equipment such as an HVAC or heat pump units employing a compressor and/or blower having a simplified design that reduces the number of parts required to manufacture the device. Moreover, it is desirable to provide a single HVAC or heat pump unit that has multiple configurations while using a relatively few number of parts.

SUMMARY

A heating or cooling device such as an HVAC unit or heat pump unit (referred to hereafter as "the device") has a simplified design that reduces the number of parts required for manufacture relative to some conventional units, and the same set of parts is capable of being configured in multiple configurations. For example, the same set of parts can be used to provide a heat pump that can be configured in a left-hand air inlet configuration and a right-hand air inlet configuration. The device can be offered as a left-hand air inlet unit and a right-hand air inlet unit under a single stock keeping unit (SKU), reducing the amount of inventory that needs to be kept on hand by the seller.

The device allows an easy conversion between the left-hand and the right-hand air inlet configurations in the field. In some embodiments, easy conversion between the left-hand and the right-hand air inlet configurations in the field is achieved by providing the device with water inlet and outlet connections on each of opposed sides of the device, where open water connections are provided on one side only, for example the front-facing side, regardless of whether the device is configured in a left-hand air inlet configuration or a right-hand air inlet configuration.

In still other embodiments, easy conversion between the left-hand and the right-hand air inlet configurations in the field is achieved by providing the device with front and back panels that are interchangeable to fulfill a left or right return configuration.

In still other embodiments, easy conversion between the left-hand and the right-hand air inlet configurations in the field is achieved by making the control board of the device accessible from a front-facing side of the device, regardless of whether the device is in a left-hand or right-hand air inlet configuration. The control board may include, for example, control electronics mounted on a printed circuit board, and may be housed in an electronics box (referred to herein as an "e-box") that is stored in the device. In some embodiments, the control board may be made accessible by utilizing a sliding mechanism to withdraw the e-box from the device from either of opposed sides of the device. In other embodiments, the e-box is detachably stored within the unit, and the control board may be made accessible by removing the e-box from the unit and temporarily mounting it on either of opposed sides of the device.

One or more of these strategies for achieving conversion between left-hand and right-hand air inlet configurations may be incorporated into one unit. As a result, the device allows for easy installation and serviceability in the field, and in particular provides easy access to the major components such as the compressor, blower, heat exchangers, the e-box including the control board and inverter, the thermal expansion valve (TXV), the electronic expansion valve (EEV), the reversing valve, etc., regardless of whether the device is configured in a left-hand air inlet configuration or a right-hand air inlet configuration.

In some embodiments, the inverter is disposed in the e-box, and the e-box may be stored in the air handler section of the device. Because the inverter is stored in the air handler section of the device, it may be cooled by convection as facilitated by relatively increased movement of air within the air handling portion as compared to storage within the condensing section of the device.

It is understood that the invention is not limited in its application to the details of construction and the arrangement of components set forth in the following description or illustrated in the following drawings. The invention is capable of other embodiments and of being practiced or of being carried out in various ways.

In some aspects, an environmental control unit includes a housing having a first end that rests on a support surface, a second end that is spaced apart from the first end, and a sidewall that extends between the first end and the second end. The sidewall includes a first side, a second side, a third side and a fourth side. The housing includes an air inlet provided in the first side, and an air outlet provided in the second end. The environmental control unit includes a blower disposed in the housing. The blower is configured to draw air into the housing via the air inlet and to exhaust air from the housing via the air outlet. The environmental control unit includes a first heat exchanger disposed in the housing between the air inlet and the blower, and a second heat exchanger disposed in the housing, the first heat exchanger and the second heat exchanger being connected via a closed-loop line that circulates refrigerant, the second heat exchanger including a first fluid inlet, a first fluid outlet, a second fluid inlet and a second fluid outlet. The environmental control unit also includes a compressor disposed in housing, and an expansion valve disposed in the housing. The first fluid inlet is connected to a first port in the second side of the sidewall and the second side adjoins the first side. The first fluid outlet is connected to a second port in the second side. The second fluid inlet is connected to a third port in the third side of the sidewall, and the third side adjoins the first side and is disposed opposite to the second side. The second fluid outlet is connected to a fourth port in the third side. The environmental control unit can be configured in a first configuration in which the first side including faces a first direction and a second configuration in which the first side faces a second direction. The first direction is opposite the second direction. When the environmental control unit is configured in the first configuration, the first fluid inlet and the first fluid outlet are open, and the second fluid inlet and the second fluid outlet are closed, and when the environmental control unit is configured in the second configuration, the first fluid inlet and the first fluid outlet are closed, and the second fluid inlet and the second fluid outlet are open.

In some embodiments, the environmental control unit includes an e-box and a control board that is disposed in the e-box, a broad surface of the control board residing in a first plane. The e-box is configured to be moved between a retracted position in which the e-box is disposed in the housing, and first or second extended positions that are different from the retracted position and in which the control board is accessible from outside the housing. The first extended position is disposed on the sidewall second side, the second extended position is disposed on the sidewall third side, and the sidewall third side is opposite the sidewall second side.

In some embodiments, when the e-box is in the first or second extended position, the e-box is disposed outside the housing.

In some embodiments, the e-box is movable between the retracted position and the first or second extended position via a slide mechanism.

In some embodiments, when the e-box is in the retracted position, the e-box is supported on a first set of brackets. When the e-box is in the first or second extended position, the e-box is supported on a second set of brackets, and the e-box is detached from the housing when being moved between the retracted position and the first or second extended position.

In some embodiments, when the e-box is in the retracted position, the first plane is parallel to the housing first end, and when the e-box is in the first or second extended position the first plane is parallel to the housing first end.

In some embodiments, when the e-box is in the retracted position, the first plane is parallel to the housing first end, and when the e-box is in the first or second extended position the first plane is angled relative to the housing first end.

In some embodiments, a divider panel segregates an interior space of the housing into an air handler section that includes the blower and a condensing section that includes the condenser, and when the e-box is in the retracted position, the e-box is disposed in the air handler section.

In some embodiments, a divider panel segregates an interior space of the housing into an air handler section that includes the blower and a condensing section that includes the condenser, and when the e-box is in the retracted position, the e-box is disposed in the condensing section.

In some embodiments, the blower and the e-box are disposed in a common compartment of the environmental control unit, and the e-box is cooled via convective air flow generated by the blower.

In some embodiments, the second heat exchanger is arranged in a coil that is centered on, and surrounds, a coil axis. The second heat exchanger is disposed in the housing adjacent to the housing first end, and the second heat exchanger is oriented within the housing so that the coil axis is substantially perpendicular to the housing first end.

In some embodiments, the compressor is disposed on the housing first end and is surrounded by the second heat exchanger.

In some embodiments, the second heat exchanger is arranged in a coil that is centered on, and surrounds, a coil axis. The second heat exchanger is disposed in the housing so as to be closer to the housing first end than the housing second end, and the second heat exchanger is oriented within the housing so that the coil axis is a) parallel to the housing first end, and b) acutely angled relative to a plane defined by the housing air inlet.

In some embodiments, the second heat exchanger is arranged in a coil that is centered on, and surrounds, a coil axis. The second heat exchanger is disposed in the housing so as to be closer to the housing first end than the housing second end, and the second heat exchanger is oriented within the housing so that the coil axis is a) parallel to the housing first end, and b) substantially parallel to a plane defined by the housing air inlet.

In some aspects, an environmental control unit includes a housing having a first end that rests on a support surface, a second end that is spaced apart from the first end and a sidewall that extends between the first end and the second end. The side wall includes a first side, a second side, a third side and a fourth side. The housing has an air inlet provided in the first side, and an air outlet provided in the second end. The environmental control unit includes a blower disposed in the housing, and the blower is configured to draw air into the housing via the air inlet and to exhaust air from the housing via the air outlet. The environmental control unit includes a first heat exchanger disposed in the housing between the air inlet and the blower, and a second heat exchanger disposed in the housing, the first heat exchanger and the second heat exchanger being connected via a closed-loop line that circulates refrigerant. The environmental control unit includes a compressor disposed in housing and an expansion valve disposed in the housing. In addition, the environmental control unit includes an e-box and a control board that is disposed in the e-box. A broad surface of the control board resides in a first plane. The e-box is configured to be moved between a retracted position in which the e-box is disposed in the housing, and first or second extended positions that are different from the retracted position and in which the control board is accessible from outside the housing. The first extended position is disposed on the sidewall second side, and the second extended position being disposed on the sidewall third side, the sidewall third side being opposite the sidewall second side.

In some embodiments, when the e-box is in the first or second extended position, the e-box is disposed outside the housing.

In some embodiments, the e-box is movable between the retracted position and the first or second extended position via a slide mechanism.

In some embodiments, when the e-box is in the retracted position, the e-box is supported on a first set of brackets. When the e-box is in the first or second extended position, the e-box is supported on a second set of brackets, and the e-box is detached from the housing when being moved between the retracted position and the first or second extended position.

In some embodiments, when the e-box is in the retracted position, the first plane is parallel to the housing first end, and when the e-box is in the first or second extended position the first plane is angled relative to the housing first end.

In some embodiments, when the e-box is in the retracted position, the first plane is perpendicular to the housing first end, and when the e-box is in the first or second extended position the first plane is angled relative to the housing first end.

In some embodiments, a divider panel segregates an interior space of the housing into an air handler section that includes the blower and a condensing section that includes the condenser. When the e-box is in the retracted position, the e-box is disposed in the air handler section.

In some embodiments, the second heat exchanger is arranged in a coil that is centered on, and surrounds, a coil axis. The second heat exchanger is disposed in the housing adjacent to the housing first end, and the second heat exchanger is oriented within the housing so that the coil axis is substantially perpendicular to the housing first end.

In some embodiments, the second heat exchanger includes a first fluid inlet, a first fluid outlet, a second fluid inlet and a second fluid outlet. The first fluid inlet is connected to a first port in the second side of the sidewall, the second side adjoining the first side. The first fluid outlet is connected to a second port in the second side. The second fluid inlet is connected to a third port in the third side of the sidewall, the third side adjoining the first side and being disposed opposite to the second side. The second fluid outlet is connected to a fourth port in the third side. The environmental control unit can be configured in a first configuration in which the first side including faces a first direction and a second configuration in which the first side faces a second direction. The first direction is opposite the second direction. When the environmental control unit is configured in the first configuration, the first fluid inlet and the first fluid outlet are open, and the second fluid inlet and the second fluid outlet are closed, and when the environmental control unit is configured in the second configuration, the first fluid inlet and the first fluid outlet are closed, and the second fluid inlet and the second fluid outlet are open.

BRIEF DESCRIPTION OF THE FIGURES

In FIG. 1, solid lines represent cold or cool fluid and broken lines represent hot or warm fluid. In addition, narrow arrows represent refrigerant and wide arrows represent air or water as appropriate.

FIG. 2 is a perspective view of the water source heat pump of FIG. 1.

DETAILED DESCRIPTION

Figure 1A:
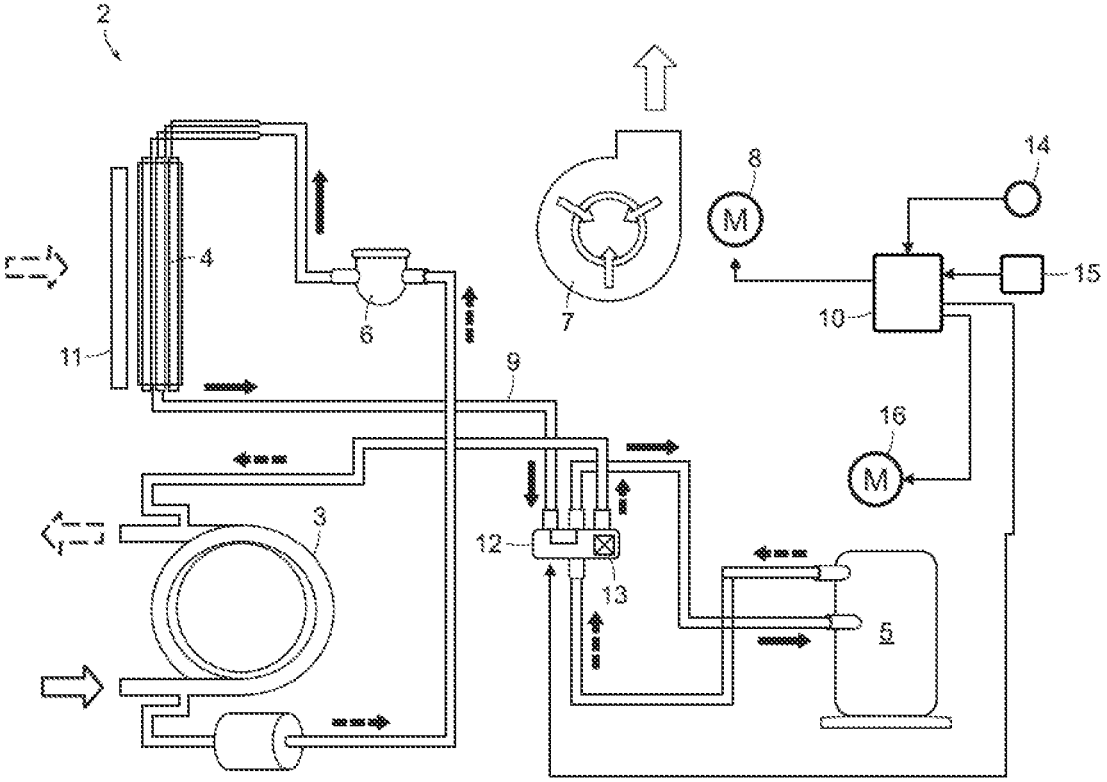
FIG. 1A is a schematic diagram of a water source heat pump, including arrows that represent fluid-flow during a cooling operation of the heat pump.
Figure 1B:
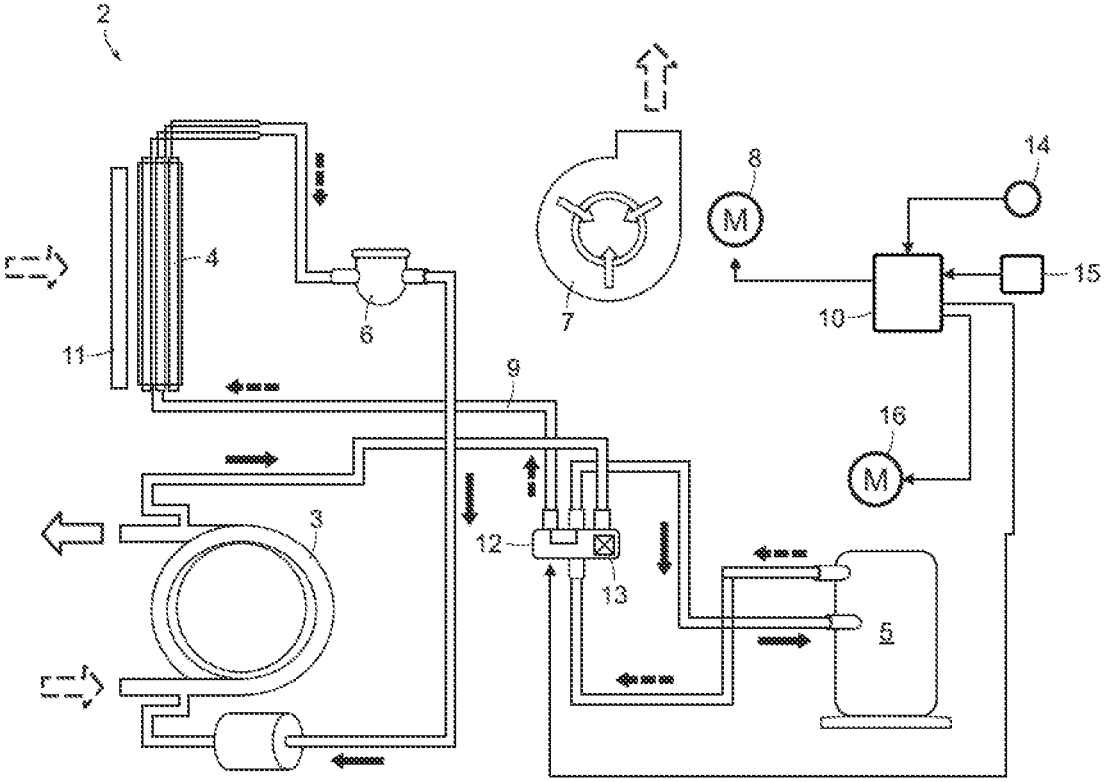
FIG. 1B is a schematic diagram of the water source heat pump of FIG. 1, including arrows that represent fluid flow during a heating operation of the heat pump.
Figure 2:
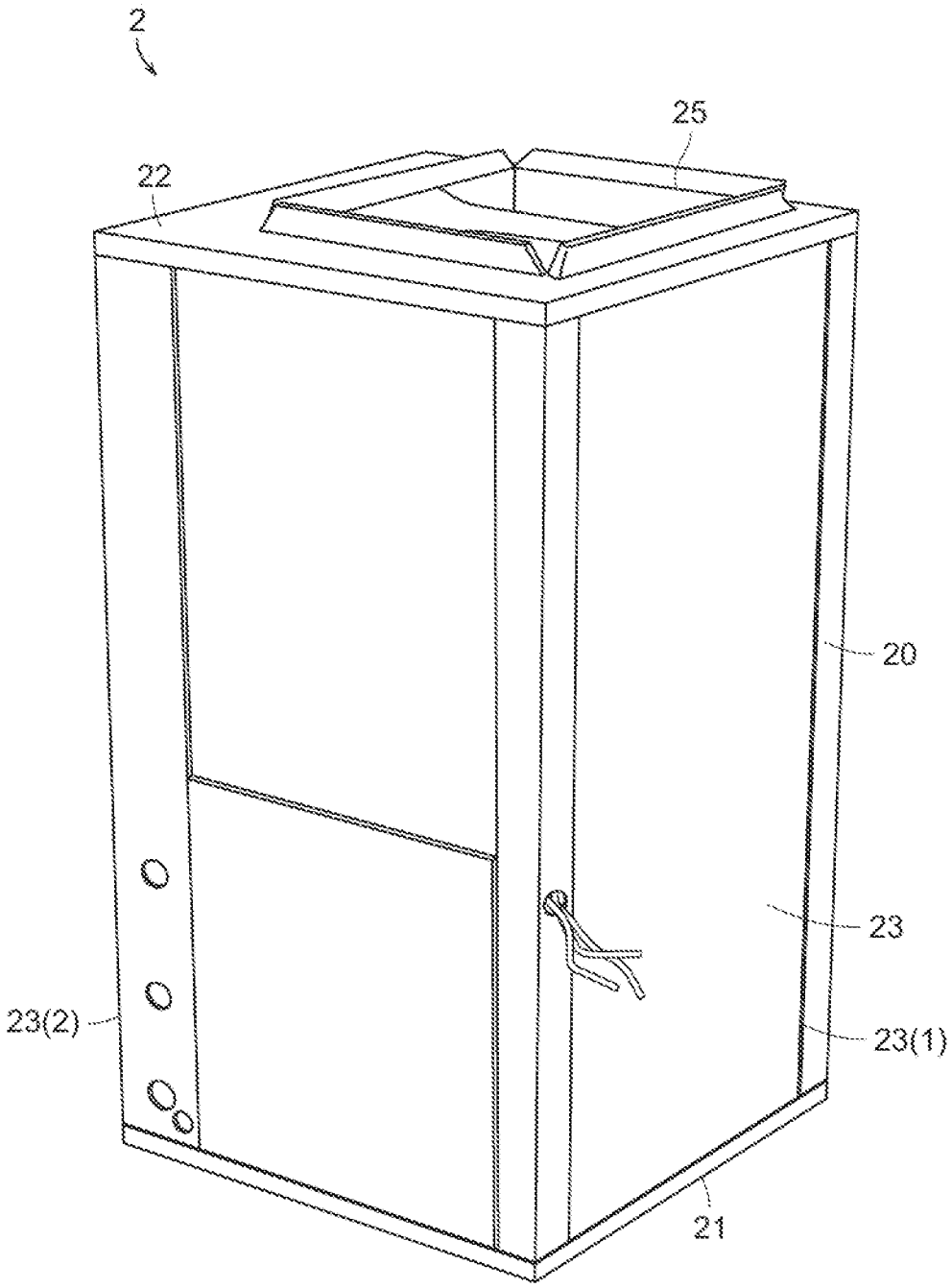
In FIG. 2, solid lines represent cold or cool fluid and broken lines represent hot or warm fluid. In addition, narrow arrows represent refrigerant and wide arrows represent air or water as appropriate.

Referring to FIGS. 1A and 1B, an environmental control unit such as a water source heat pump 2 may be used to control the environment within a closed space such as the interior of a building by providing heating and/or cooling functions. The heat pump 2 is an assembly of several components, including heat exchangers 3, 4, a compressor 5, an expansion valve 6 and a blower 7 that is configured to draw air through the heat exchanger 4. The heat pump 2 may include other ancillary components such as an air filter 11, and a controller 10 that is configured to control operation of the heat pump 2 based on input from a user via a user input device such as a thermostat 15. The heat pump 2 may also include noise reduction features (not shown) that reduce the amount of noise generated by the heat pump 2 during operation. The heat pump 2 has a simplified construction requiring fewer parts than some conventional heat pumps, and is capable of being configured in multiple configurations to accommodate the requirements of a variety of applications, as discuss further below.

The heat pump 2 is a water source heat pump that includes a fluid circuit in the form of a reversible cooling/heating loop 9. The reversible cooling/heating loop 9 permits the heat pump 2 to be switchable between heating and cooling functions. To this end, the heat pump 2 includes a water-to-refrigerant heat exchanger 3 and an air-to-refrigerant heat exchanger 4 that may function either as an evaporator or a condenser depending on the heat pump operation mode. For example, when heat pump 2 is operating in cooling mode (FIG. 1A), the water-to-refrigerant heat exchanger 3 functions as a condenser, releasing heat to the water, while the air-to-refrigerant heat exchanger 4 functions as an evaporator, absorbing heat from the ambient air. When heat pump 2 is operating in heating mode (FIG. 1B), the water-to-refrigerant heat exchanger 3 functions as an evaporator, absorbing heat from the water, while the air-to-refrigerant heat exchanger 4 functions as a condenser, releasing heat to the ambient air. The heat pump 2 will be described herein as though configured to perform a cooling function within the building 1. In addition, the heat pump 2 includes a reversing valve 12 that is positioned in the loop 9 between the heat exchangers 3, 4 to control the direction of refrigerant flow and thereby to switch the heat pump 2 between heating mode and cooling mode. In the illustrated example, the reversing valve 12 is controlled by the controller 10 via, for example, a solenoid 13.

In the illustrated embodiment, the heat pump 2 includes an air-to-refrigerant heat exchanger 4. The air-to-refrigerant heat exchanger 4 is an air coil unit having fluid circuits comprised of serially-connected thermally conductive tubes (not shown). The air-to-refrigerant heat exchanger 4 is mounted in an air inlet 24 provided on one side of the heat pump housing 20. An air filter 11 overlies the air inlet 24. Air is drawn into the heat pump housing 20 through the an filter 11 and the air coil unit of the heat exchanger 4 via a blower 7 that is also disposed in the heat pump housing 20 adjacent to the heat exchanger 4. The blower 7 is driven by blower motor 8 and discharges air from the heat pump housing 20 via an air outlet 25.

The compressor 5 may be any suitable compressor such as a screw compressor, reciprocating compressor, rotary compressor, swing link compressor, scroll compressor, or turbine compressor.

The expansion valve 6 may be, for example, a thermal expansion valve (TXV) 6, and is positioned in the loop 9 between the water source heat exchanger 3 and the air source heat exchanger 4. The TXV 6 is configured to decrease the pressure and temperature of the refrigerant before it enters the evaporator. The TXV 6 may also regulate the refrigerant flow entering the evaporator so that the amount of refrigerant entering the evaporator equals, or approximately equals, the amount of refrigerant exiting the evaporator.

In the illustrated embodiment, the fluid that passes through the loop 9 is a refrigerant, although it is not limited thereto. The refrigerant may be any fluid that absorbs and extracts heat.

During a cooling operation, the refrigerant enters the air-to-refrigerant heat exchanger 4 (e.g., the evaporator) as a low temperature and pressure liquid. Some vapor refrigerant also may be present as a result of the expansion process that occurs in the TXV 6. The refrigerant flows through the air-to-refrigerant heat exchanger 4 and absorbs heat from the air, changing the refrigerant into a vapor. After exiting the evaporator, the refrigerant passes through reversing valve 12 and into the compressor 5. The compressor 5 decreases the volume of the refrigerant vapor, thereby, increasing the temperature and pressure of the vapor. After exiting from the compressor 5, the increased temperature and pressure vapor refrigerant flows into the water-to-refrigerant heat exchanger 3 (e.g., the condenser). In the water-to-refrigerant heat exchanger 3, the refrigerant vapor flows into the water coil while water is cycling throughout. The heat from the refrigerant is transferred to the water causing the refrigerant to condense into a liquid. After exiting the water-to-refrigerant heat exchanger 3, the liquid refrigerant flows through the TXV 6 and returns to the air-to-refrigerant heat exchanger 4 (e.g., the evaporator) as a low temperature and pressure liquid, where the cooling process begins again.

A motor 16 drives the compressor 5 and circulates refrigerant through the loop 9. The operation of the compressor motor 16 is controlled by the controller 10. The controller 10 receives information from the input device 15 and a temperature sensor 14, and uses the information to control the operation of heat pump 2 in both cooling mode and heating mode. In addition, the controller 10 uses information received from the input device 15 to switch the heat pump 2 between the heating mode and the cooling mode. For example, if the input device 15 is set to the cooling mode, the controller 10 will send a signal to the solenoid 13 to place reversing valve 12 in an air conditioning position. Consequently, the refrigerant will flow through reversible loop 9 as described above. If the input device 15 is set to the heating mode, the controller 10 will send a signal to the solenoid 13 to place the reversing valve 12 in a heating position. Consequently, the refrigerant will flow through the reversible loop 9 as follows: the refrigerant exits compressor 5, is condensed in the air-to-refrigerant heat exchanger 4, is expanded in the TXV 6, and is evaporated in the water-to-refrigerant heat exchanger 3.

Figure 7:
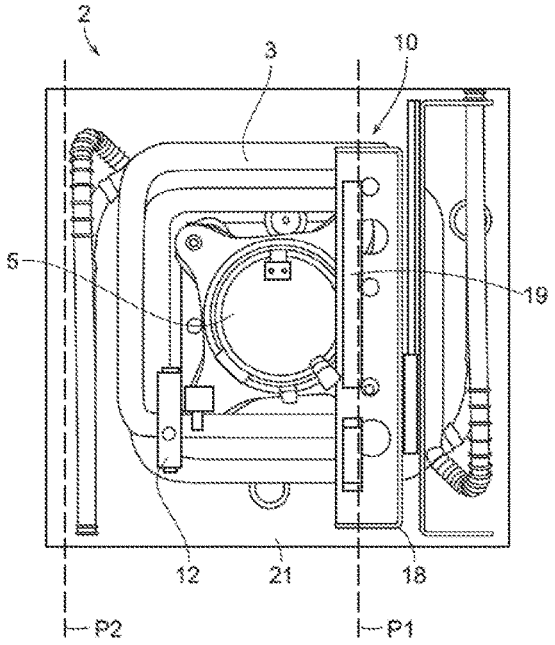
FIG. 7 is a top view of the heat pump of FIG. 6 as seen along line 7-7 of FIG. 6.
Figure 8:
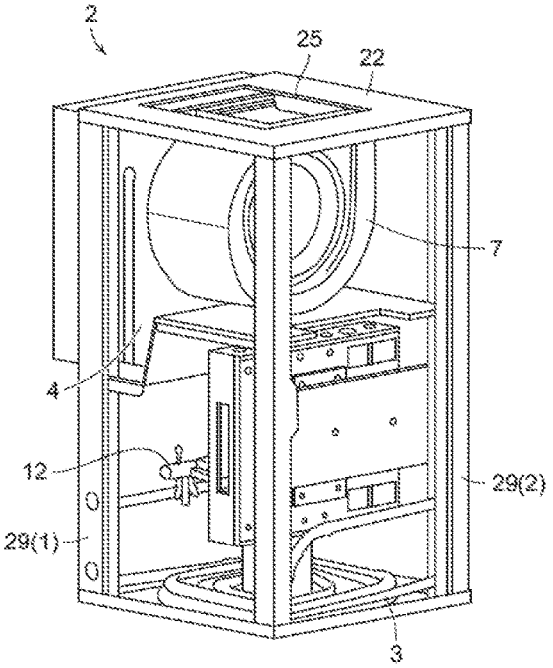
FIG. 8 is a rear perspective view of the heat pump of FIG. 5.
Figure 9:
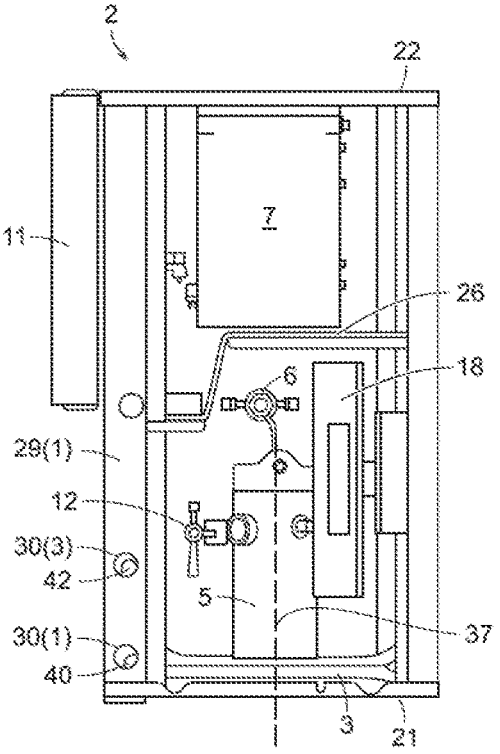
FIG. 9 is a side view of the heat pump of FIG. 5.
Figure 10:
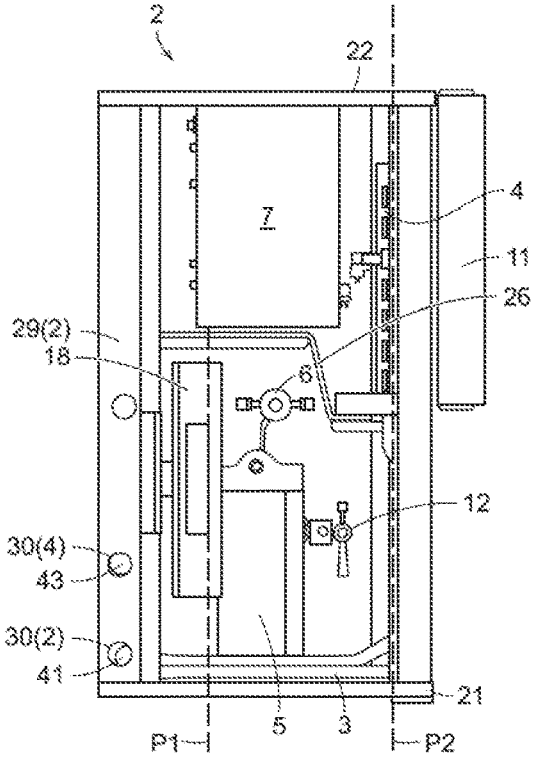
FIG. 10 is a side view of the heat pump of FIG. 3.
Figure 11:
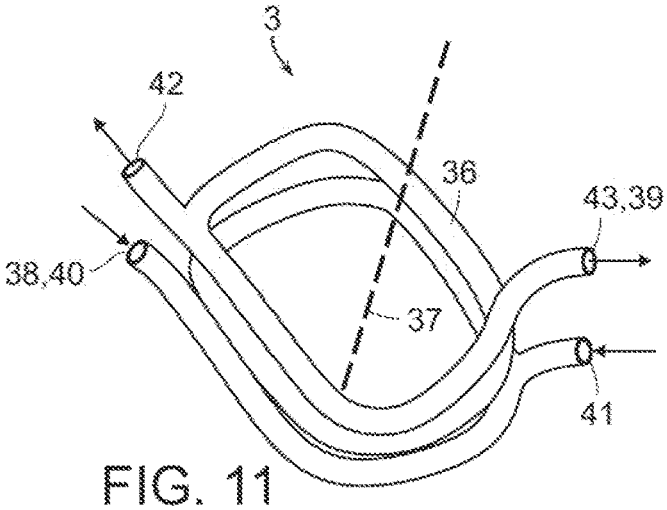
FIG. 11 is a top perspective view of a coiled water-to-refrigerant heat exchanger.
Figure 12:
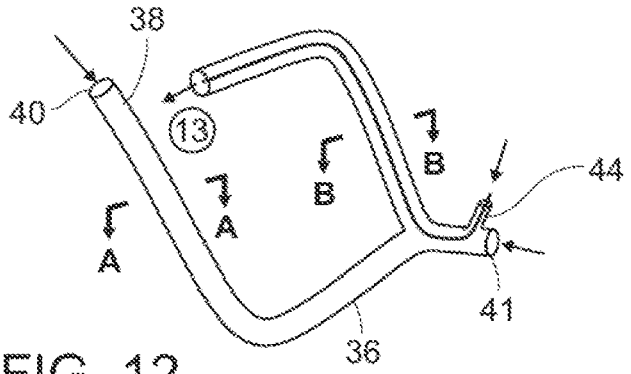
FIG. 12 is a top view of first turn or lower-most coil of the heat exchanger of FIG. 11.
Figure 13:
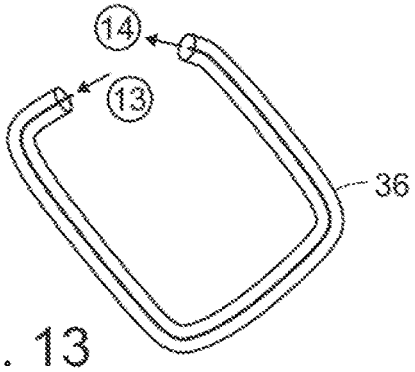
FIG. 13 is a top view of a central turn or intermediate coil of the heat exchanger of FIG. 11.
Figure 14:
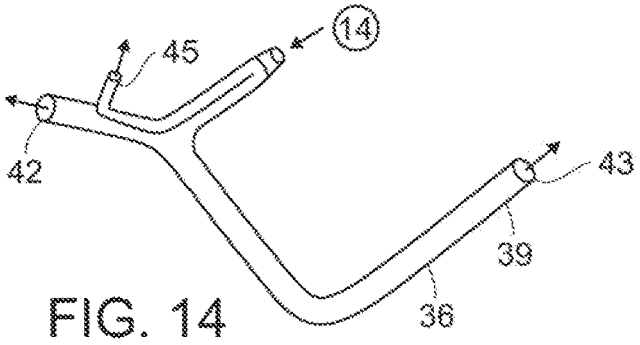
FIG. 14 is a top view of the last turn or upper-most coil of the heat exchanger of FIG. 11.
Figure 12A:
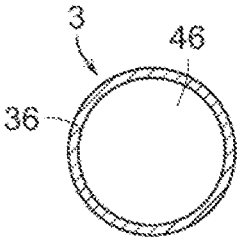
FIG. 12A is a cross sectional view of the tube of the heat exchanger of FIG. 11 as seen along line A-A.
Figure 12B:
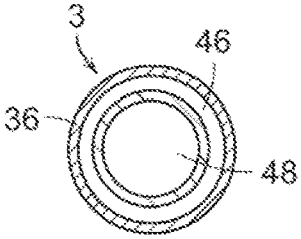
FIG. 12B is a cross sectional view of the tube of the heat exchanger of FIG. 11 as seen along line B-B.
Figure 15:
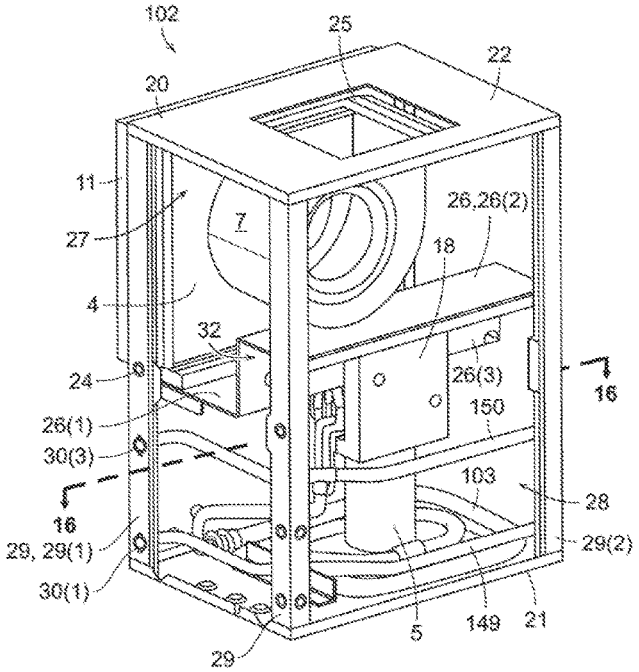
FIG. 15 is a front perspective view of an alternative embodiment heat pump, shown in a left-hand air inlet configuration, with housing sidewalls omitted to show the arrangement of some of the main components of the heat pump within the heat pump housing, and illustrating the e-box in a retracted position relative to the housing.
Figure 16:
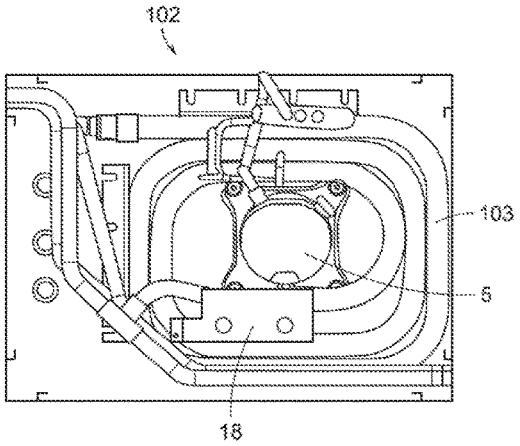
FIG. 16 is a top view of the heat pump of FIG. 15 as seen along line 16-16 of FIG. 15.

The controller 10 includes a processor or microprocessor (not shown) that is configured to execute hardware or software control algorithms to monitor and regulate heat pump 2. In some exemplary embodiments, the controller 10 may include an inverter, an analog to digital (A/D) converter, a non-volatile memory, and other ancillary electronic components that are supported on a printed circuit board 19. The printed circuit board 19 that supports these electronic devices may be housed in a protective electronics box 18, referred to hereafter as an "e-box". The e-box 18 has the shape of low-profile rectangular prism in that the e-box 18 has a height that is much less that its length and width. In the illustrated embodiments, the printed circuit board 19 is supported within the e-box 18 so that a broad surface of the printed circuit board 19 resides in a first plane P1 that is perpendicular or substantially perpendicular to the height dimension of the e-box 18 (FIG. 7). As used herein, the term "control board 10" refers to the printed circuit board 19 in combination with the controller 10, the inverter and other associated electronic components.

Referring also to FIGS. 2-10, the heat pump housing 20 includes a closed first end or bottom 21 corresponding to an end of the heat pump 2 that rests on a support surface such as the ground, a floor or a shelf. The heat pump housing 20 includes a closed second end or top 22 that is opposed to the first end 21. The first and second ends 21, 22 may be supported on an interior frame that includes four corner posts 29, and a sidewall 23 that extends between the first and second ends 21, 22 and surrounds the corner posts 29. In the illustrated embodiment, the corner posts 29 extend vertically.

In addition, the heat pump housing 20 includes a divider panel 26 that segregates an interior space of the housing 20 into an air handler section 27 and a condensing section 28, where the condensing section 28 underlies the air handler section 27. The divider panel 26 is non-planar and has a z-shaped cross section. The divider panel 26 includes a first planar portion 26(1), a second planar portion 26(2) and a ramp portion 26(3) that joins the first planar portion 26(1) to the second planar portion 26(2). The first planar portion 26(1) is parallel or substantially parallel to the housing first end 21 and adjoins a first side 23(1) of the sidewall 23 at a location below the air inlet 24. The second planar portion 26(2) is parallel or substantially parallel to the housing first end 21 and adjoins a second side 23(2) of the sidewall 23, where the second side 23(2) of the sidewall 23 is parallel or substantially parallel to, and spaced apart from, the first side 23(1) of the sidewall 23, and the second planar portion 26(2) is further from the housing first end 21 than is the first planar portion 26(1).

The air inlet 24 is provided in the sidewall 23 at a location that is closer to the second end 22 than the first end 21 so as to communicate with the air handler section 27. The air outlet 25 is provided in the second end 22 and permits air to exit the housing 20. The air-to-refrigerant heat exchanger 4 is disposed in the air handler section 27 at a location corresponding to the air inlet 24, and the blower 7 is disposed adjacent to the air-to-refrigerant heat exchanger 4 and is connected to the air outlet 25. The blower 7 may be, for example, a squirrel cage blower. The blower 7 draws air into the heat pump housing 20. Air drawn into the heat pump housing 20 via the air inlet 24 passes through the air filter 11 and then the coils of the heat exchanger 4. Air conditioned by the air-to-refrigerant heat exchanger 4 is drawn into an inlet of the blower 7, and then exhausted from the housing air outlet 25.

In the illustrated embodiment, the compressor 5 is disposed in the condensing section 28 of the heat pump housing 20 (e.g., at a location that is below the air-to-refrigerant heat exchanger 4 and the blower 7), and rests on an inner surface of the heat pump housing first end 21.

The heat pump 2 has been designed to have a predetermined set of parts that can be arranged in multiple configurations, wherein each configuration of the multiple configurations is suitable for a unique set of requirements. As a result, the heat pump 2 has many fewer parts than some conventional heat pumps, and a single stock keeping unit (SKU) is used to represent all the configurations. For example, in the illustrated embodiment, the heat pump 2 can be configured in a first configuration in which the air inlet 24 is positioned on a first side of the housing 20 (e.g., a left-hand side) and a second configuration in which the air inlet 24 is positioned on a second side of the housing (e.g., a right-hand side), and the transition between the left-hand configuration and the right-hand configuration is made easy. In addition, the heat pump 2 is configured so that the water inlet and water outlet for the water-to-refrigerant heat exchanger 3 are provided on a left side of the front-facing side of the housing 20, regardless of whether the heat pump 2 is configured in a left-side or right-side air return configuration. Further, the heat pump 2 is configured to permit easy access to the major components (compressor, expansion valve, heat exchangers, reversing valve, etc.) for maintenance and service. Still further, the heat pump 2 is configured to provide easy access to the control board 10 for installation, maintenance and service of the heat pump 2.

Figure 3:
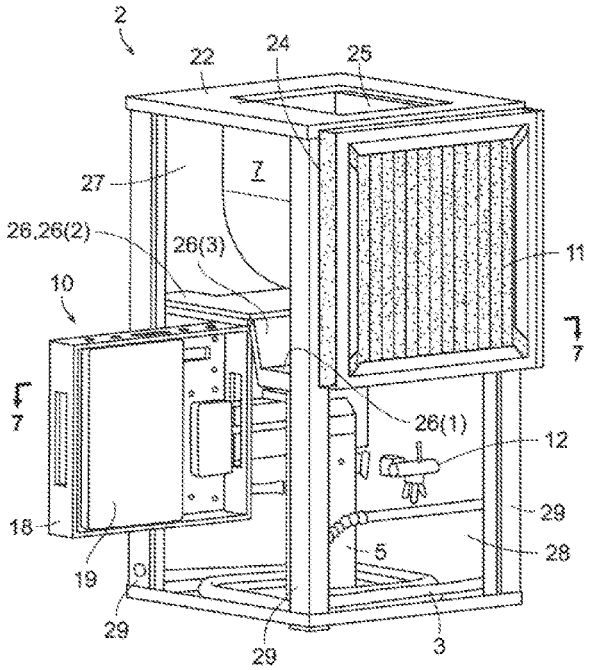
FIG. 3 is a front perspective view of the heat pump of FIG. 1 shown in a right-hand air inlet configuration, with housing sidewalls omitted to show the arrangement of some of the main components of the heat pump within the heat pump housing, and illustrating the electronics box in an extended position relative to the housing.
Figure 4:
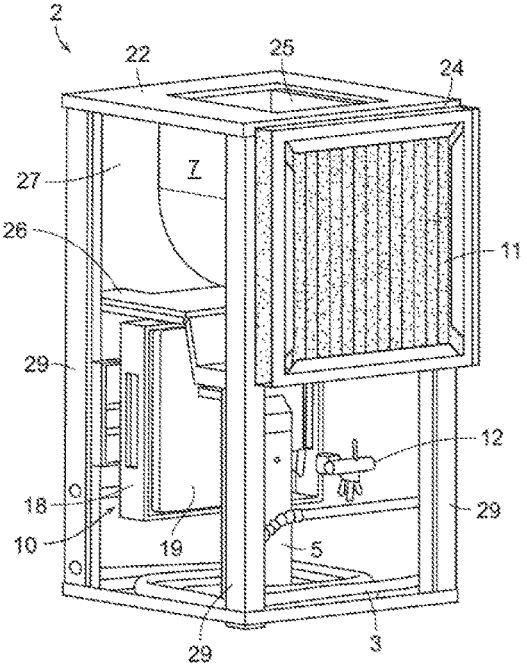
FIG. 4 is the perspective view of the heat pump of FIG. 3 shown with the e-box in retracted position relative to the housing.
Figure 5:
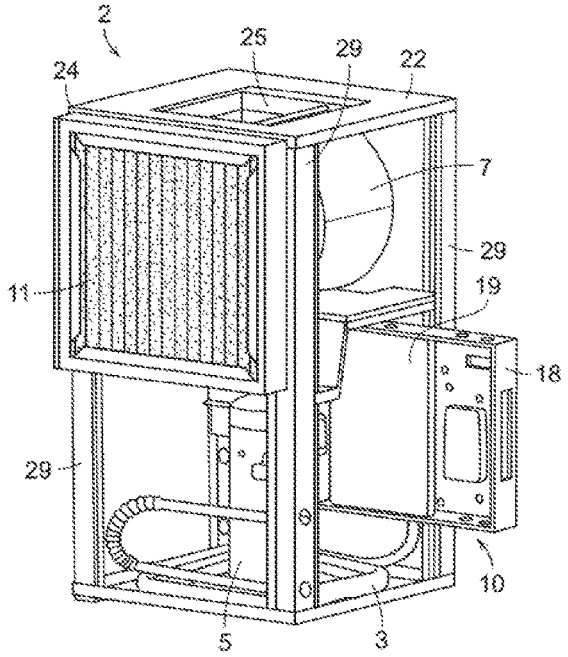
FIG. 5 is a front perspective view of the heat pump of FIG. 1 shown in a left-hand air inlet configuration, with housing sidewalls omitted to show the arrangement of some of the main components of the heat pump within the heat pump housing, and illustrating the e-box in an extended position relative to the housing.
Figure 6:
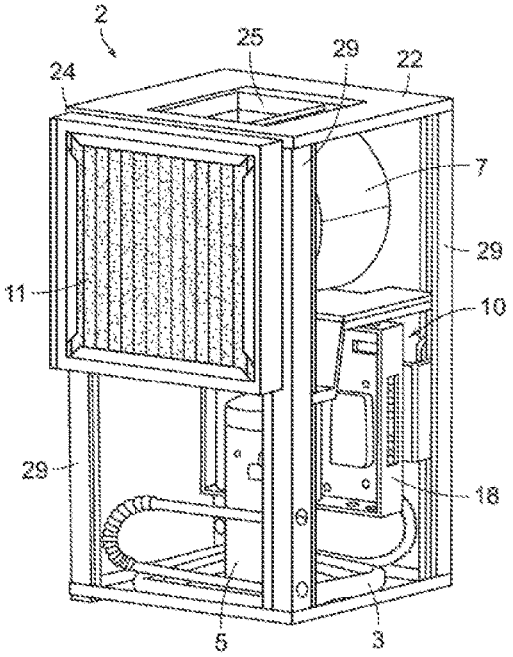
FIG. 6 is the perspective view of the heat pump of FIG. 5 shown with the e-box in a retracted position relative to the housing.

Referring to FIGS. 2-10, in order to achieve the above described configurability, the e-box 18 is supported within the housing 20 so as to be suspended above the housing first end 21. For example, the e-box 18 may be secured to a pair of adjacent corner posts 29 so that the plane P1 extends vertically. In addition, the plane P1 is perpendicular or substantially perpendicular to a front-facing side of the housing, and parallel or substantially parallel to a plane P2 defined by the air inlet 24. The e-box 18 is partially disposed within a recess defined between the divider plate ramp portion 26(3) and the divider plate second planar portion 26(2) so as to maximize the distance between the e-box 18 and the housing first end 21. In addition, the e-box 18 is configured to translate relative to the housing 20 via a slide mechanism 32 in a direction that is parallel or substantially parallel to the first plane P1. The slide mechanism 32 permits the e-box 18 to move between a retracted position in which the e-box 18 resides within the condensing section 28 of the housing 20, and an extended position in which the e-box 18 resides outside the housing 20. As shown in FIGS. 3 and 5, the slide mechanism 32 permits extension with respect to both of opposed sides, of the housing 20.

Referring, to FIGS. 11-14, in order to achieve the above described configurability, the water-to-refrigerant heat exchanger 3 is disposed on the housing first end 21 in a horizontal orientation. In this embodiment, the water-to-refrigerant heat exchanger 3 is a dual, concentric lumen tube 36 in which the inner lumen provides a refrigerant passageway 48, and the outer lumen surrounds (or "jackets") the inner lumen and provides a water passageway 46. The tube 36 has a first end 38, and second end 39 that is opposed to the first end 38, and is coiled around a coil axis 37. In this embodiment, the coil axis 37 is perpendicular or substantially perpendicular to the housing first end 21. The coils are stacked so that each coil (or turn) resides in a unique plane, and the coil planes are spaced apart along the coil axis 37. The water-to-refrigerant heat exchanger 3 includes a first water inlet 40 disposed at the first end 38 of the tube 36, and a second water inlet 41 that is disposed between the tube first and second ends 38, 39. In this embodiment, the second water inlet 41 is disposed in the same coil as the first water inlet 40 and on an opposed side of the coil relative to the first water inlet 40. The water-to-refrigerant heat exchanger 3 includes a first refrigerant inlet 44 that is disposed between the tube first and second ends 38, 39. In this embodiment, the refrigerant inlet is disposed closely adjacent to the second water inlet 41. The water-to-refrigerant heat exchanger 3 includes a first water outlet 42 and a refrigerant outlet 45 that are disposed between the tube first and second ends 38, 39. In this embodiment, the refrigerant outlet 45 is disposed closely adjacent to the first water outlet 42. In addition, the first water outlet 42 and the refrigerant outlet 45 are located in the last coil of the tube 36 at a location that is aligned with the first water inlet 40 in a direction parallel or substantially parallel to the coil axis 37. The water-to-refrigerant heat exchanger 3 includes a second water outlet 43 that is disposed at the second end 39 of the tube 36.

The first water inlet 40 is connected to a first port 30(1) disposed in a first corner post 29(1), and the second water inlet 41 is connected to a second port 30(2) disposed in a second corner post 29(2). The first water outlet 42 is connected to a third port 30(3) disposed in the first corner post 29(1), and the second water outlet 43 is connected to a fourth port 30(4) disposed in the second corner post 29(2). The first and second corner posts 29(1), 29(2) are on diagonally opposed corners of the housing 20. In this embodiment, the first and second ports 30(1), 30(2) open along a side of the housing 20 that is adjacent to the side that includes the air inlet 24 and the air-to-refrigerant heat exchanger 4. In addition, the third and fourth ports 30(3), 30(4) open along a side of the housing 20 that is opposite to the side that includes the first and second ports 30(1), 30(2). That is, the third and fourth ports 30(3), 30(4) open along a side of the housing 20 that is opposite to the side that includes the first and second ports 30(1), 30(2).

When the heat pump 2 is in a left-hand air inlet configuration, the first corner post 29(1) is on the front and left corner of the housing 20. In this configuration, the first water inlet 30 and the first water inlet 40 and first port 30(1) are open, and the first water outlet 42 and the third port 30(3) are open, and the first and third ports 30(1), 30(3) are easily accessible for connection. In addition, the second water inlet 41 and the second water outlet 43 are closed, for example by capping or plugging the respective second and fourth ports 30(2), 30(4).

When the heat pump 2 is in a right-hand air inlet configuration, the second corner post 29(2) is on the front and left corner of the housing 20. In this configuration, the second water inlet 41 and the second port 30(2) are open, and the second water outlet 43 and the fourth port 30(4) are open, and the second and fourth ports 30(2), 30(4) are easily accessible for connection. In addition, the first water inlet 40 and the first water outlet 42 are closed, for example by capping or plugging the respective first and third ports 30(1), 30(3).

In this embodiment, the water-to-refrigerant heat exchanger 3 is disposed on the housing first end 21 such that the coil axis 37 is perpendicular or substantially perpendicular to the housing first end 20, and the compressor 5 disposed on the housing first end 21 so as to be surrounded by the water-to-refrigerant heat exchanger 3.

Since the E-box is positioned in a vertical orientation at a location adjacent to the divider panel 26, since the water-to-refrigerant heat exchanger 3 is disposed on the housing first end 21 in a horizontal orientation and since the compressor is surrounded by the water-to-refrigerant heat exchanger 3, the reversing valve 12 and expansion valve 6 can be positioned in locations that are accessible from either side of the housing 20. In other words, the reversing valve 12 and expansion valve 6 can be positioned in locations that are accessible regardless of whether the heat pump 2 is in the right- or left-hand air inlet configuration. In the illustrated embodiment, the reversing valve 12 is disposed between the e-box 18 and the divider panel ramp portion 26(3), and the expansion valve 6 is disposed between the compressor 5 and the sidewall 23 on a side of the compressor 5 that is opposed to the e-box 18.

Figure 17:
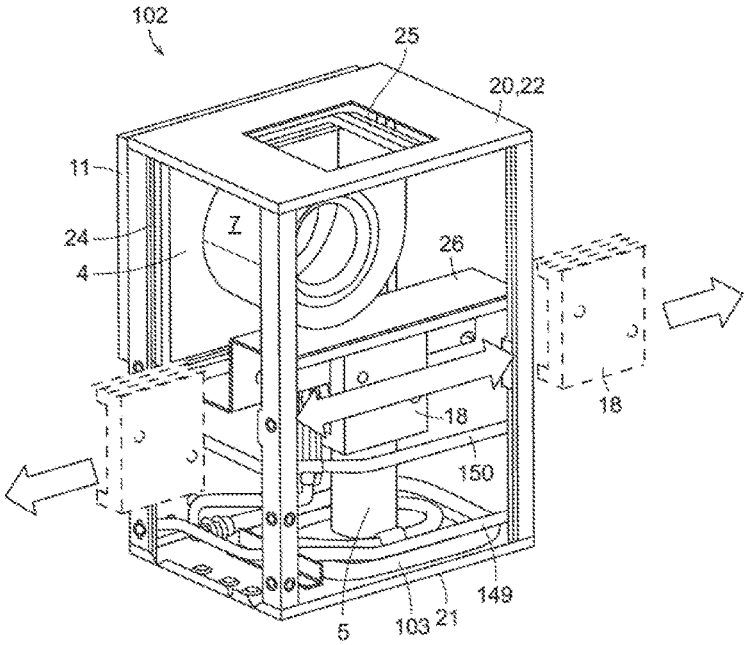
FIG. 17 is the perspective view of the heat pump of FIG. 15 shown with the e-box in extended positions relative to the housing, illustrating that the e-box can be extended out of each of the opposed sides of the housing.
Figure 18:
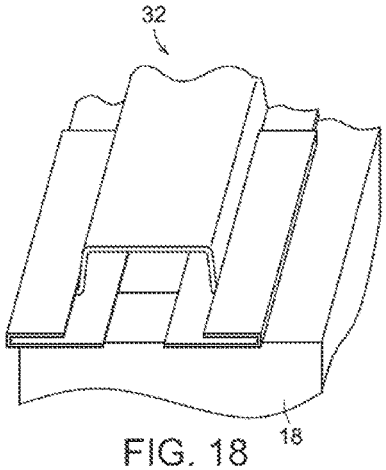
FIG. 18 is a detail view of the encircled portion of FIG. 17 showing an example of a slide mechanism used to connect the e-box to the divider panel.
Figure 19:
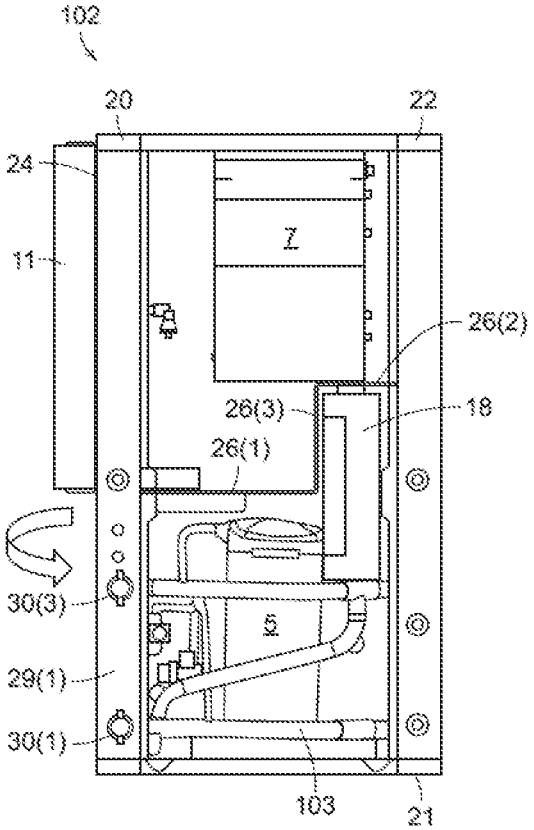
FIG. 19 is a side view of the heat pump of FIG. 15 shown in a left-hand air inlet configuration.
Figure 20:
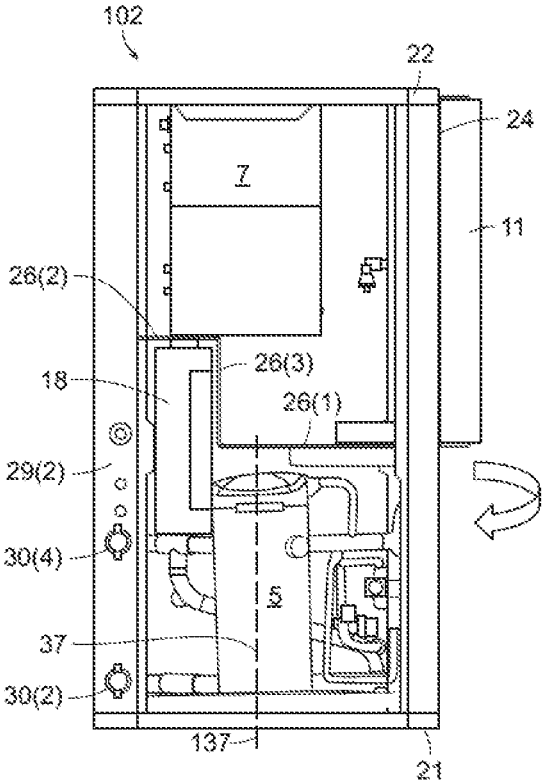
FIG. 20 is a side view of the heat pump of FIG. 15 shown in a right-hand air inlet configuration.
Figure 21:
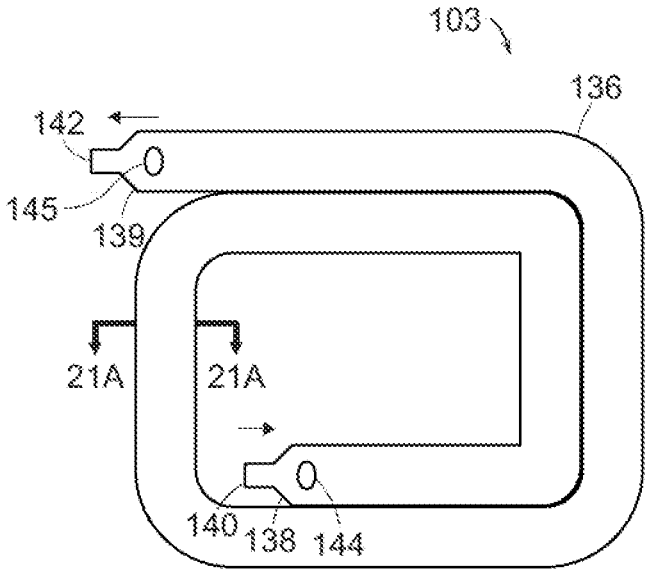
FIG. 21 is a top view of an alternative embodiment coiled water-to-refrigerant heat exchanger.
Figure 21A:
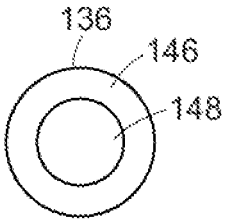
FIG. 21A is a cross sectional view of the tube of the heat exchanger of FIG. 21 as seen along line 21A-21A.
Figure 22:
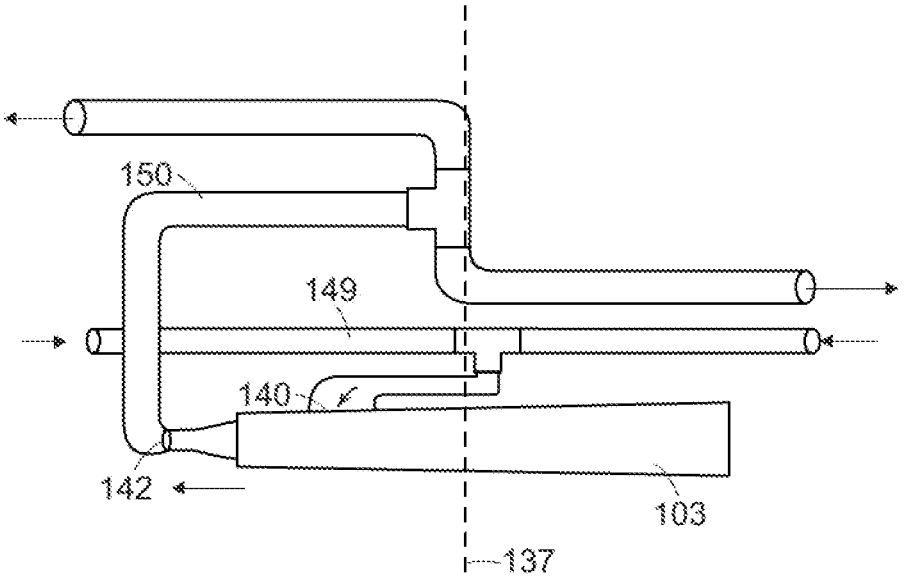
FIG. 22 is a schematic diagram of the heat exchanger of FIG. 21 including an example of a pipe configuration.
Figure 23:
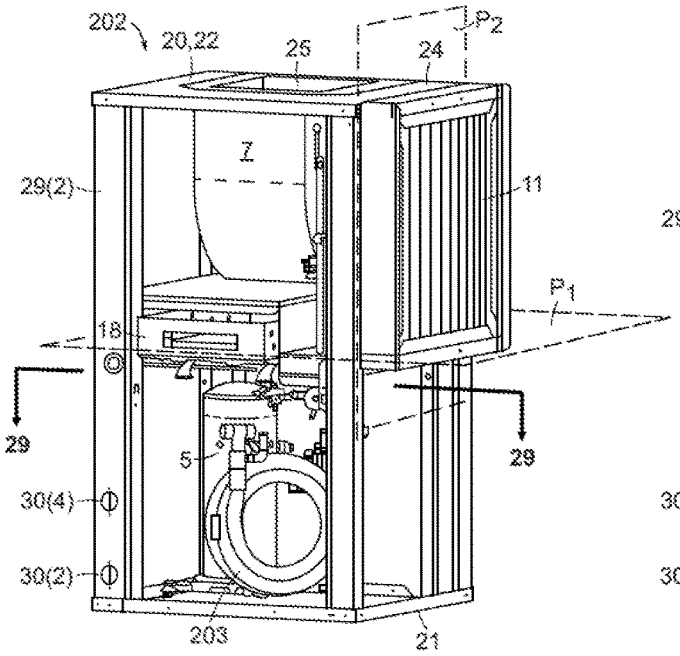
FIG. 23 is a front perspective view of another alternative embodiment heat pump, shown in a right-hand air inlet configuration, with housing sidewalls omitted to show the arrangement of some of the main components of the heat pump within the heat pump housing, and illustrating the e-box in a retracted position relative to the housing.

Referring to FIGS. 15-22, an alternative embodiment heat pump 102 is similar to the heat pump 2 described above with respect to FIGS. 1-14, and provides at least the same advantages. Elements that are common with the previous embodiment are referred to with common reference numbers. The heat pump 102 differs from the heat pump 2 with respect to how the e-box 18 is mounted within the housing 20. In the heat pump 102, the e-box 18 is secured to the divider panel 26 rather than the corner posts 29. In particular, the e-box 18 is mounted to the condensing section-facing surface of the divider panel second planar portion 26(2) using a slide mechanism 32. As in the previous embodiment, the e-box 18 is configured to translate relative to the housing 20 via the slide mechanism 32 in a direction that is parallel or substantially parallel to the first plane P1. The slide mechanism 32 permits the e-box 18 to move between a retracted position in which the e-box 18 resides within the condensing section 28 of the housing 20, and an extended position in which the e-box 18 resides outside the housing 20. As shown in FIG. 17, the slide mechanism 32 permits extension with respect to both of opposed sides of the housing 20.

The heat pump 102 differs from the heat pump 2 in that it includes an alternative embodiment water-to-refrigerant heat exchanger 103 that is disposed on the housing first end 21 in a horizontal orientation. In this embodiment, the water-to-refrigerant heat exchanger 103 is a dual, concentric lumen tube 136 in which the inner lumen provides a refrigerant passageway 148, and the outer lumen surrounds (or "jackets") the inner lumen and provides a water passageway 146. The tube 136 has a first end 138, and second end 139 that is opposed to the first end 138, and is coiled around a coil axis 137. In this embodiment, the coil axis 137 is perpendicular or substantially perpendicular to the housing first end 21. The coils are wound so that all the coils (or turns) reside in a common plane, and the coils are side-by-side in a radial direction with respect to the coil axis 37. The water-to-refrigerant heat exchanger 103 includes a water inlet 140 disposed at the first end 138 of the tube 136, and a water outlet 142 that is disposed at the tube second end 139. The water-to-refrigerant heat exchanger 103 includes a refrigerant inlet 144 that is disposed between the tube first and second ends 138, 139. In this embodiment, the refrigerant inlet 144 is disposed closely adjacent to the water inlet 140. The water-to-refrigerant heat exchanger 3 includes a refrigerant outlet 145 that is disposed between the tube first and second ends 138, 139. In this embodiment, the refrigerant outlet 145 is disposed closely adjacent to the water outlet 142.

The first water inlet 140 is connected to the first port 30(1) disposed in the first corner post 29(1) and the second port 30(2) disposed in the second corner post 29(2) via a first piping section 149 having a T-configuration. Likewise, the first water outlet 142 is connected to the third port 30(3) disposed in the first corner post 29(1) and the fourth port 30(4) disposed in the second corner post 29(2) via a second piping section 150 having a T-configuration. As in the previous embodiment, the first and second corner posts 29(1), 29(2) are on diagonally opposed corners of the housing 20. In addition, the first and second ports 30(1), 30(2) open along a side of the housing 20 that is adjacent to the side that includes the air inlet 24 and the air-to-refrigerant heat exchanger 4. In addition, the third and fourth ports 30(3), 30(4) open along a side of the housing 20 that is opposite to the side that includes the first and second ports 30(1), 30(2).

When the heat pump 102 is in a left-hand air inlet configuration, the first corner post 29(1) is on the front and left corner of the housing 20. In this configuration, the water inlet 140 receives water via the open first port 30(1), and the water outlet 142 discharges water to the open third port 30(3), and the first and third ports 30(1), 30(3) are easily accessible for connection. In addition, the second and fourth ports 30(2), 30(4) are closed, for example by capping or plugging the respective second and fourth ports 30(2), 30(4).

When the heat pump 102 is in a right-hand air inlet configuration, the second corner post 29(2) is on the front and left corner of the housing 20. In this configuration, the water inlet 140 receives water via the open second port 30(2), and the water outlet 142 discharges water to the open fourth port 30(4), and the second and fourth ports 30(2), 30(4) are easily accessible for connection. In addition, the first and third ports 30(1), 30(3) are closed, for example by capping or plugging the respective first and third ports 30(1), 30(3).

In this embodiment, the water-to-refrigerant heat exchanger 103 is disposed on the housing first end 21 such that the coil axis 137 is perpendicular or substantially perpendicular to the housing first end 20, and the compressor 5 is disposed on the housing first end 21 so as to be surrounded by the water-to-refrigerant heat exchanger 103. The "flat" coil configuration of the heat exchanger 103 provides more space within the condensing section 28 as compared to the previous embodiment, which can be used to improve accessibility of the internal components and/or accommodating more complex piping structures.

Figure 24:
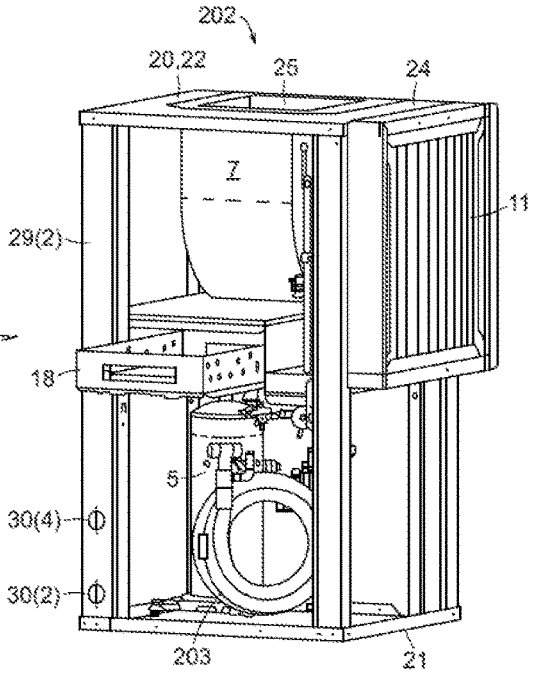
FIG. 24 is the perspective view of the heat pump of FIG. 23 shown with the e-box in a partially extended position relative to the housing.
Figure 25:
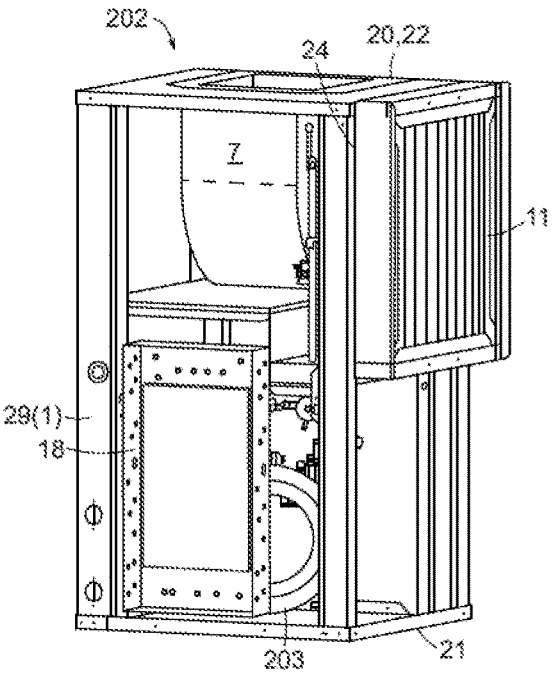
FIG. 25 is the perspective view of the heat pump of FIG. 23 shown with the e-box in a fully extended position relative to the housing.
Figure 26:
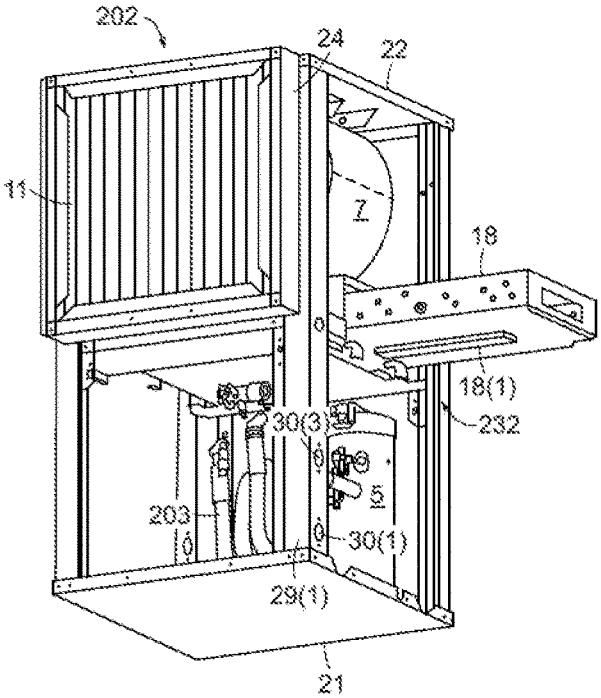
FIG. 26 is a side perspective view of the heat pump of FIG. 23 shown in a left-hand air inlet configuration, with housing sidewalls omitted to show the arrangement of some of the main components of the heat pump within the heat pump housing, and illustrating the e-box in a partially extended position relative to the housing.
Figure 27:
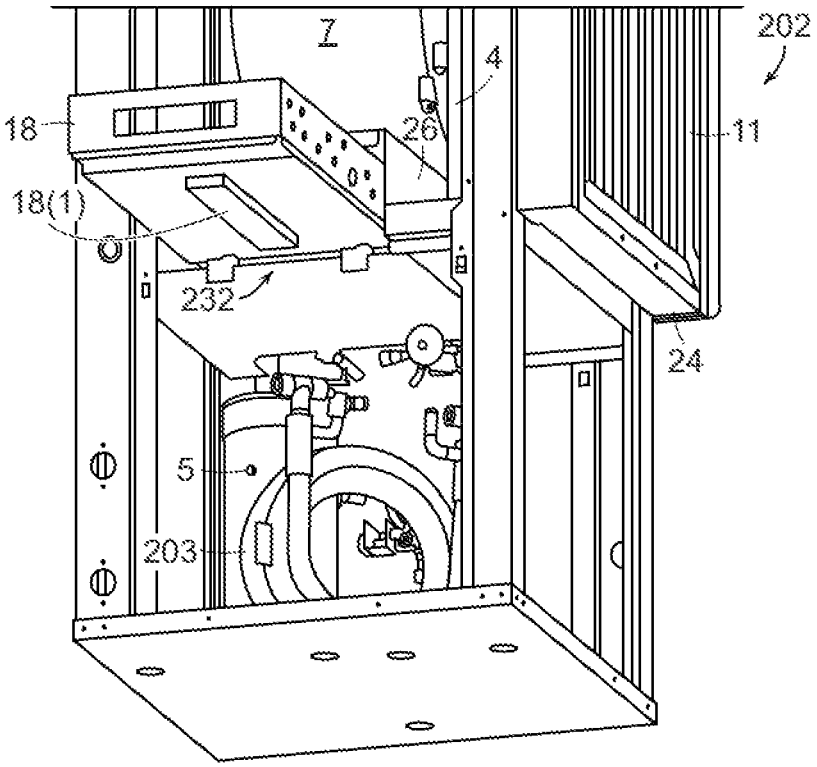
FIG. 27 is a bottom perspective view of a portion of the heat pump of FIG. 24.
Figure 28:
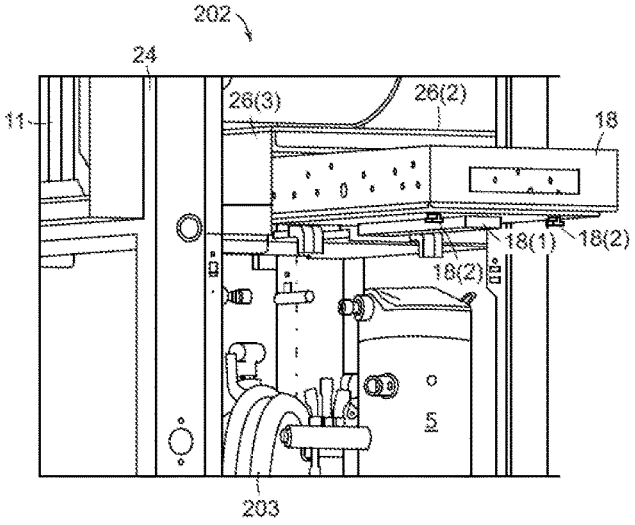
FIG. 28 is a side perspective view of a portion of the heat pump of FIG. 26.
Figure 29:
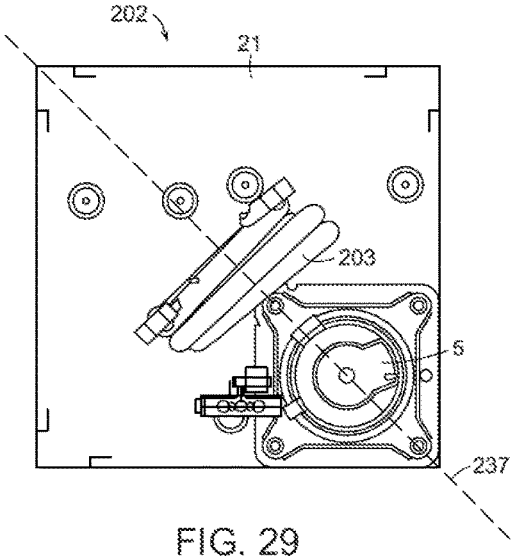
FIG. 29 is a top view of the heat pump of FIG. 23 as seen along line 29-29 of FIG. 23.
Figure 30A:
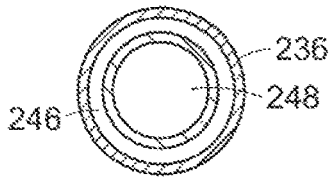
FIG. 30A is a cross sectional view of the tube of the heat exchanger of FIG. 30 as seen along line 30A-30A.
Figure 30:
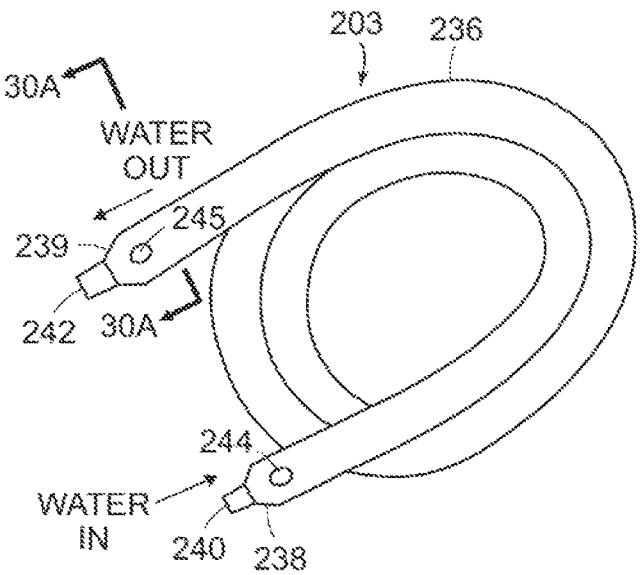
FIG. 30 is a top view of another alternative embodiment coiled water-to-refrigerant heat exchanger.
Figure 31:
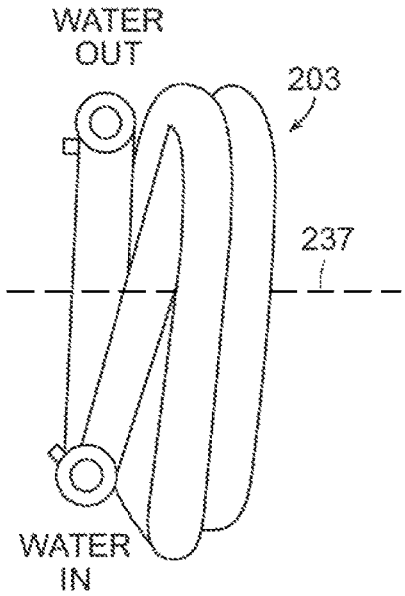
FIG. 31 is a side view of the coiled water-to-refrigerant heat exchanger of FIG. 30.
Figure 31B:
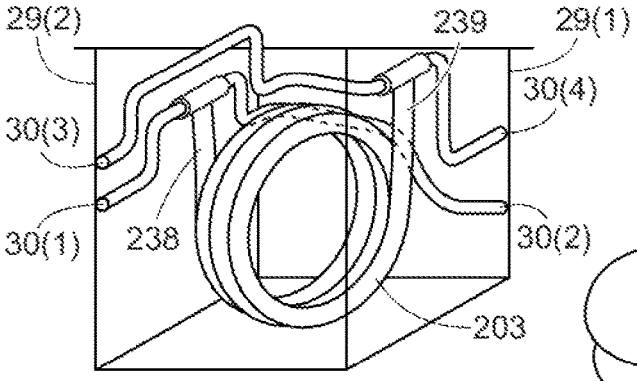
FIG. 31B is a front perspective view of a portion of the heat pump of FIG. 23 shown with housing sidewalls and most of the main components omitted to show the arrangement of the water-to-refrigerant heat exchanger and the connections of the water-to-refrigerant heat exchanger to inlets and outlets.

Referring to FIGS. 23-31, another alternative embodiment heat pump 202 is similar to the heat pump 2 described above with respect to FIGS. 1-14, and provides at least the same advantages. Elements that are common with the previous embodiments are referred to with common reference numbers. The heat pump 202 differs from the heat pump 2, 102 of the earlier embodiments with respect to how the e-box 18 is supported within the housing 20. In the heat pump 202, the e-box 18 is secured to the divider panel 26 rather than the corner posts 29. Unlike the previous embodiments, the e-box 18 is oriented so that the first plane P1 is perpendicular or substantially perpendicular to the second plane P2 whereby the control board 10 has a horizontal orientation. In this embodiment, the e-box 18 is mounted to the condensing section-facing surface of the divider panel second planar portion 26(2) using a slide-and-pivot mechanism 232. As in the previous embodiment, the e-box 18 is configured to translate relative to the housing 20 via the slide-and-pivot mechanism 232 in a direction that is parallel or substantially parallel to the first plane P1. The slide-and-pivot mechanism 232 permits the e-box 18 to move between a retracted position in which the e-box 18 resides within the condensing section 28 of the housing 20, and an extended position in which the e-box 18 resides outside the housing 20. As shown in FIGS. 24 and 26, the slide-and-pivot mechanism 232 permits extension with respect to both of opposed sides of the housing 20. When the e-box is in the fully extended position, the slide-and-pivot mechanism 232 is configured to permit the e-box 18 to pivot from a horizontal orientation to a vertical orientation that overlies the housing sidewall 23. In some embodiments, the slide-and-pivot mechanism 232 may include a groove (not shown) that receives a rail 18(1) provided on an underside of the e-box 18 (e.g., the side of the e-box 18 opposed to the divider panel 26). The slide-and-pivot mechanism 232 may also receive T-shaped posts 18(2) that protrude from the underside of the e-box 18. The T-shaped posts 18(2) retain the rail 18(1) within the groove during translation of the e-box 18, and retain the e-box 18 on the housing 20 during pivoting of the e-box 18 relative to housing 20. Two pair of T-shaped posts 18(2) are provided on the e-box 18, and one pair is disposed at each end of the e-box 18.

The heat pump 202 differs from the heat pump 2, 102 in that it includes an alternative embodiment water-to-refrigerant heat exchanger 203 that is disposed on the housing first end 21 in a vertical orientation. In this embodiment, the water-to-refrigerant heat exchanger 203 is a dual, concentric lumen tube 236 in which the inner lumen provides a refrigerant passageway 248, and the outer lumen surrounds (or "jackets") the inner lumen and provides a water passageway 246. The tube 236 has a first end 238, and second end 239 that is opposed to the first end 238, and is coiled around a coil axis 237. In this embodiment, the coil axis 237 is parallel or substantially parallel to the housing first end 21, and at an acute angle relative to a given side of the housing 20 (e.g., acutely angled relative to plane P2). For example, the coil axis 237 may extend along a diagonal of the housing 20 so as to intersect diagonally opposed corner posts 29. The coils are stacked so that each coil for turn) resides in a unique plane, and the coil planes are spaced apart along the coil axis 237. The water-to-refrigerant heat exchanger 203 includes a water inlet 240 disposed at the first end 238 of the tube 236, and a water outlet 242 that is disposed at the tube second end 239. The first coil is canted so that the water inlet 240 and the water outlet 242 are disposed on the same end of the coil stack. The water-to-refrigerant heat exchanger 203 is arranged so that the water inlet and outlet 240, 242 reside above the coils, and are each at the same distance from the housing first end 21. The diagonal arrangement, along with placement of the water inlet and outlets at the same height, allow equal pressure drop in the heat exchanger 203 regardless of right- or left-hand air inlet configuration.

The water-to-refrigerant heat exchanger 203 includes a refrigerant inlet 244 that is disposed between the tube first and second ends 238, 239. In this embodiment, the refrigerant inlet 244 is disposed closely adjacent to the water inlet 240. The water-to-refrigerant heat exchanger 3 includes a refrigerant outlet 245 that is disposed between the tube first and second ends 238, 239. In this embodiment, the refrigerant outlet 245 is disposed closely adjacent to the water outlet 242.

Although not shown, the water inlet 240 is connected to the first port 30(1) disposed in the first corner post 29(1) and the second port 30(2) disposed in the second corner post 29(2) via the first piping section 149 having a T-configuration. Likewise, the water outlet 242 is connected to the third port 30(3) disposed in the first corner post 29(1) and the fourth port 30(4) disposed in the second corner post 29(2) via the second piping section 150 having a T-configuration.

As in the previous embodiment, the first and second corner posts 29(1), 29(2) are on diagonally opposed corners of the housing 20. In addition, the first and second ports 30(1), 30(2) open along a side of the housing 20 that is adjacent to the side that includes the air inlet 24 and the air-to-refrigerant heat exchanger 4, and the third and fourth ports 30(3), 30(4) open along a side of the housing 20 that is opposite to the side that, includes the first and second ports 30(1), 30(2).

When the heat pump 202 is in a left-hand air inlet configuration, the first corner post 29(1) is on the front and left corner of the housing 20. In this configuration, the water inlet 240 receives water via the open first port 30(1), and the water outlet 242 discharges water to the open third port 30(3), and the first and thud ports 30(1), 30(3) are easily accessible for connection. In addition, the second and fourth ports 30(2), 30(4) are closed, for example by capping or plugging the respective second and fourth ports 30(2), 30(4).

When the heat pump 202 is in a right-hand air inlet configuration, the second corner post 29(2) is on the front and left corner of the housing 20. In this configuration, the water inlet 240 receives water via the open second port 30(2), and the water outlet 242 discharges water to the open fourth port 30(4), and the second and fourth ports 30(2), 30(4) are easily accessible for connection. In addition, the first and third ports 30(1), 30(3) are closed, for example by capping or plugging the respective first and thud ports 30(1), 30(3).

In this embodiment, the water-to-refrigerant heat exchanger 203 is disposed on the housing first end 21 such that the coil axis 237 is parallel or substantially parallel to the housing first end 20, and the compressor 5 is disposed in a corner of the housing 20 so as to be side-by-side with the water-to-refrigerant heat exchanger 203. The vertical and angled coil configuration of the heat exchanger 203 provides more space within the condensing section 28 as compared to some conventional heat exchangers, which can be used to improve accessibility of the internal components and/or accommodating more complex piping structures.

Figure 32:
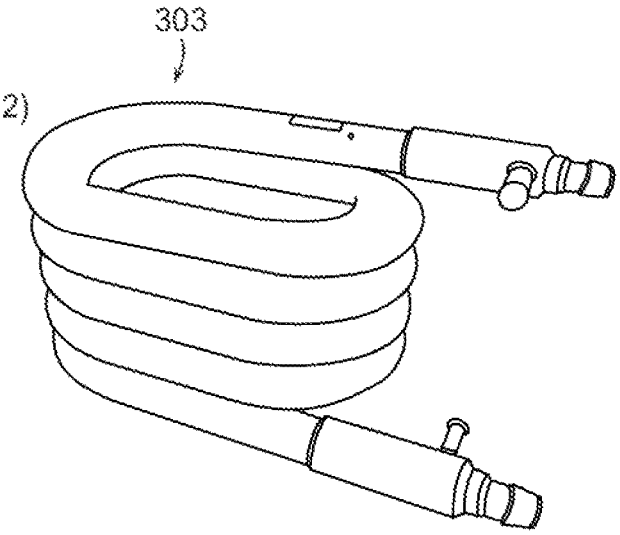
FIG. 32 is a perspective view of another alternative embodiment coiled water-to-refrigerant heat exchanger.
Figure 33:
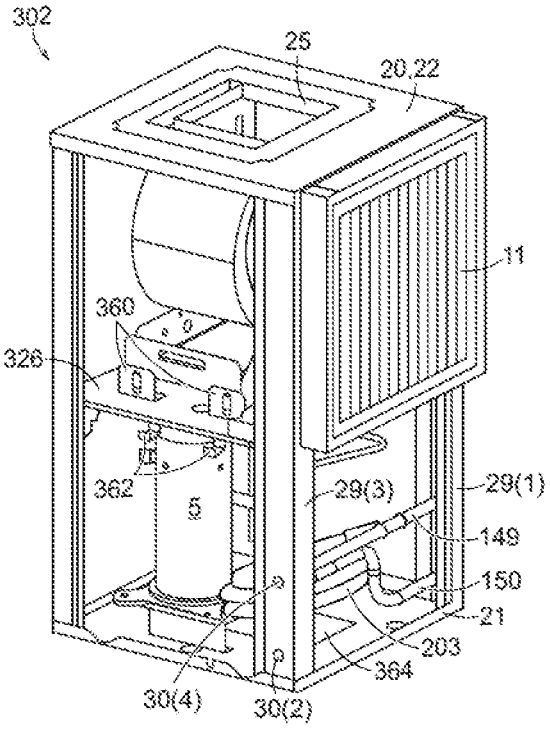
FIG. 33 is a front perspective view of another alternative embodiment heat pump, shown in a right-hand air inlet configuration, with housing sidewalls omitted to show the arrangement of some of the main components of the heat pump within the heat pump housing, and illustrating the e-box supported on brackets in a retracted position relative to the housing.
Figure 34:
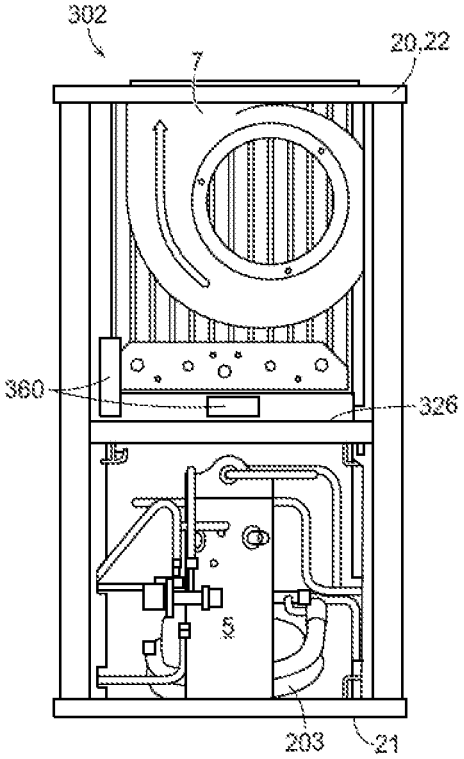
FIG. 34 is a side view of the heat pump of FIG. 33.
Figure 35:
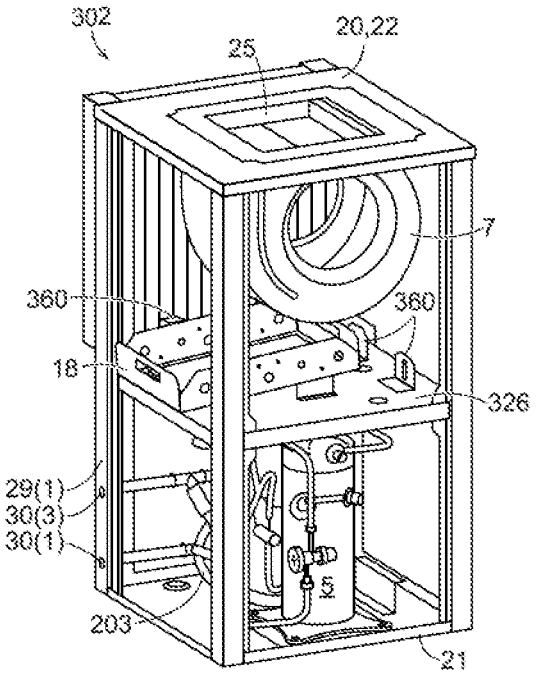
FIG. 35 is a rear perspective view of the heat pump of FIG. 33, showing the e-box detached from support brackets and in a partially extended position relative to the housing.
Figure 36:
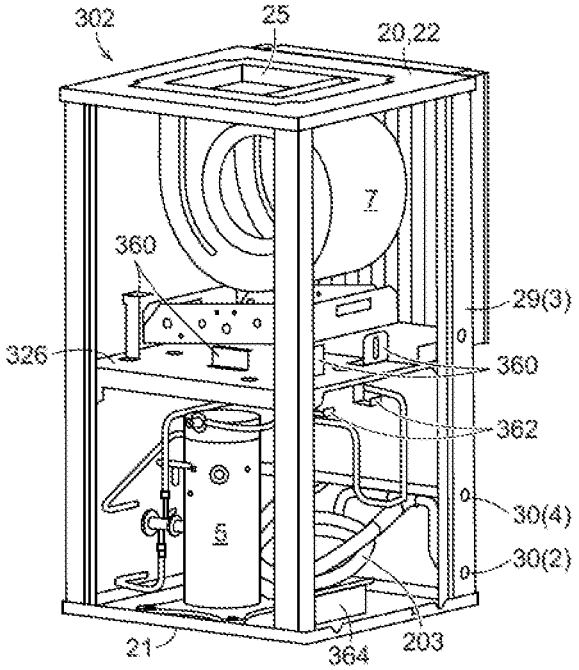
FIG. 36 is another rear perspective view of the heat pump of FIG. 33, showing the e-box detached from support brackets and in a partially extended position relative to the housing.
Figure 37:
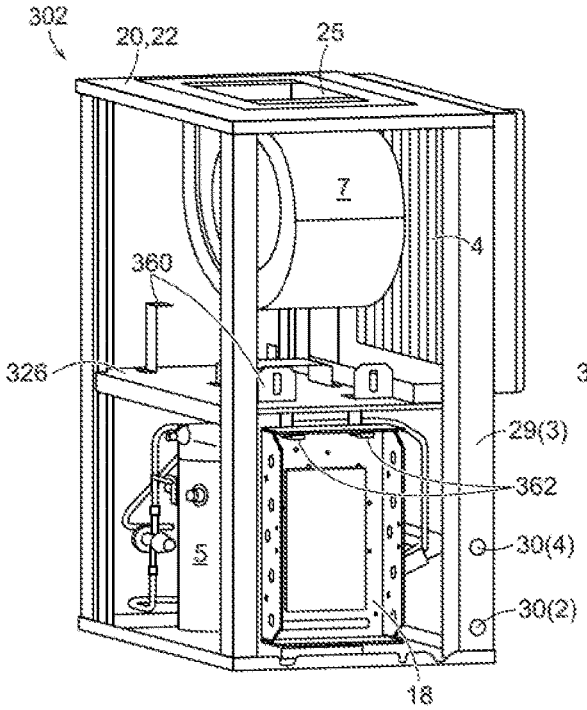
FIG. 37 is a front perspective view of the heat pump of FIG. 33, showing the e-box detached from support brackets and in a fully extended position relative to the housing.
Figure 38:
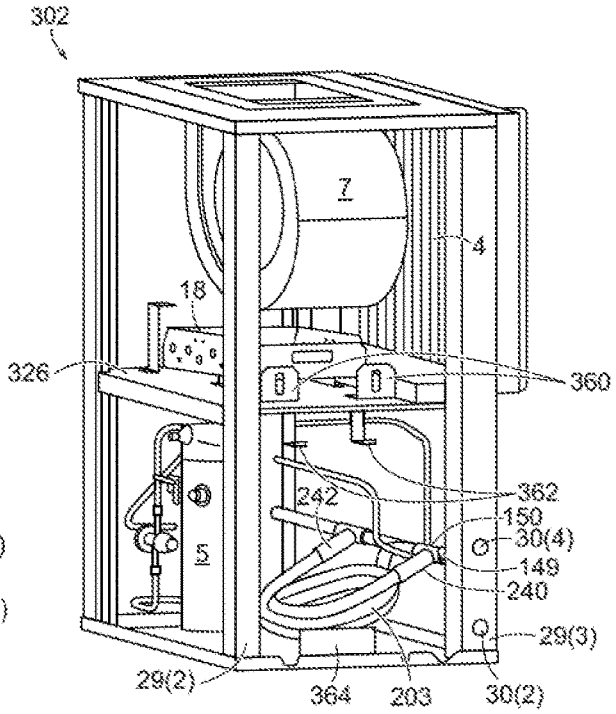
FIG. 38 is a front perspective view of the heat pump of FIG. 33, showing the e-box supported on brackets in a retracted position relative to the housing.
Figure 39:
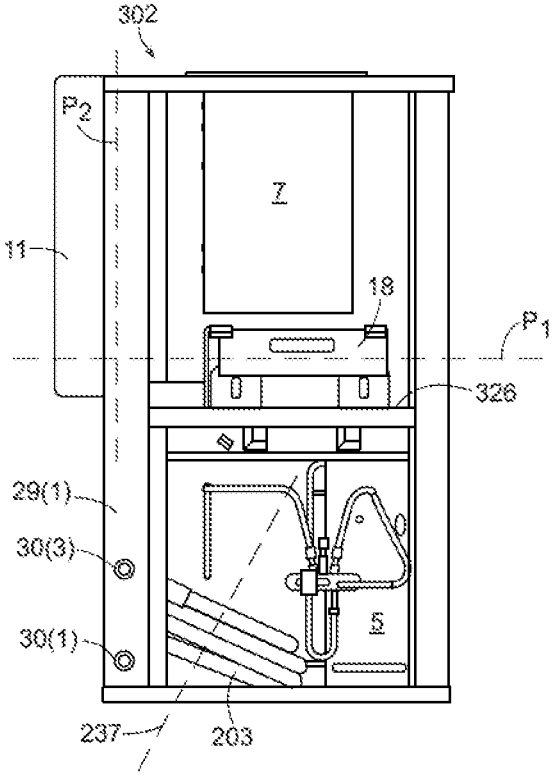
FIG. 39 is a front view of the heat pump of FIG. 33 shown in a left-hand air inlet configuration, with housing sidewalk omitted to show the arrangement of some of the main components of the heat pump within the heat pump housing, and illustrating the e-box in a partially extended position relative to the housing.
Figure 40:
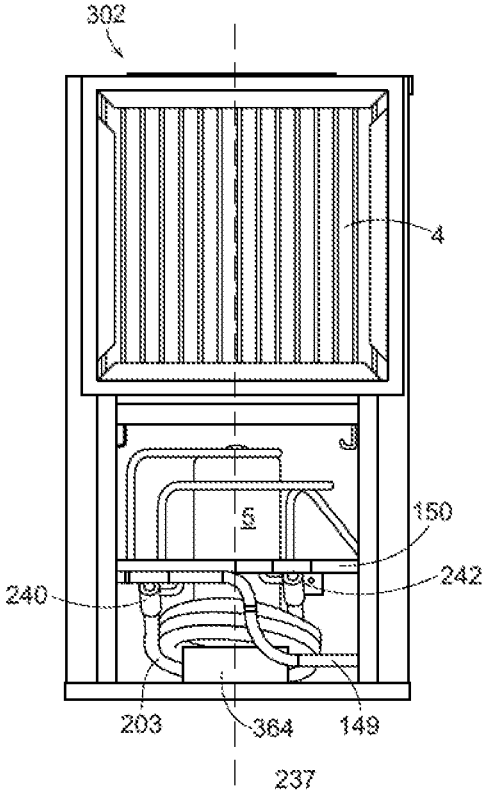
FIG. 40 is a side view of the heat pump of FIG. 39.
Figure 41:
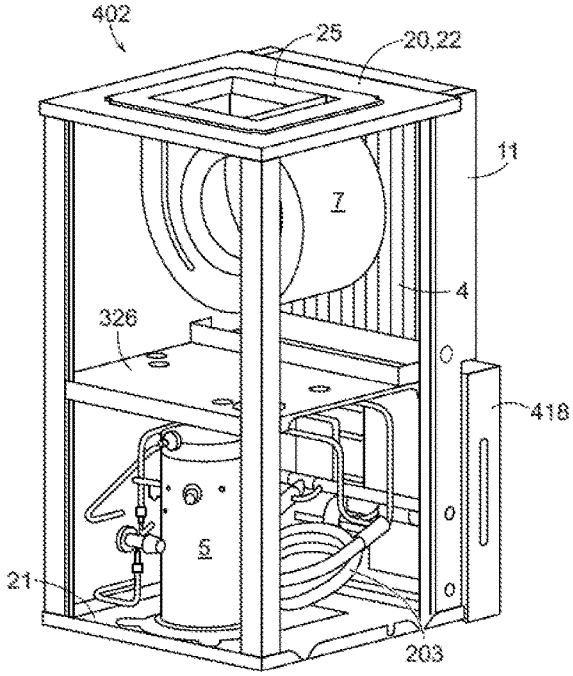
FIG. 41 is a front perspective view of another alternative, embodiment heat pump, shown in a right-hand air inlet configuration, with housing sidewalls omitted to show the arrangement of some of the main components of the heat pump within the heat pump housing, and illustrating the e-box in a retracted position relative to the housing.
Figure 42:
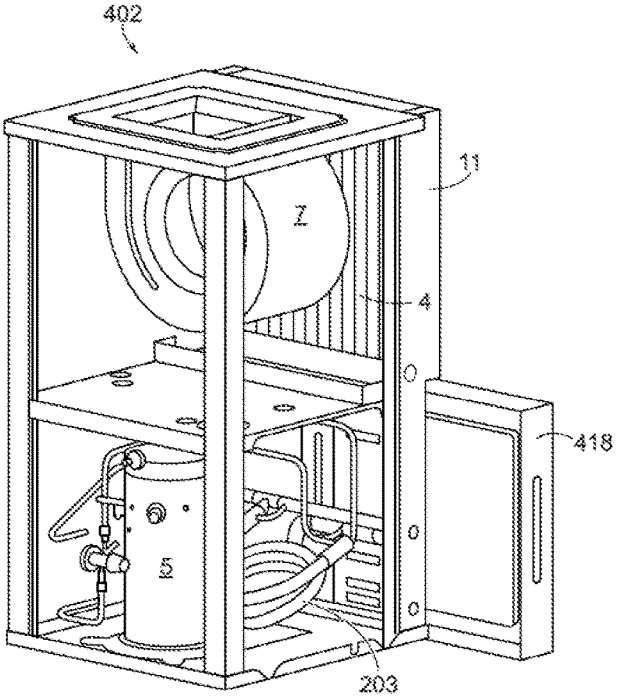
FIG. 42 is the perspective view of the heat pump of FIG. 41 shown with the e-box in a partially extended position relative to the housing.
Figure 43:
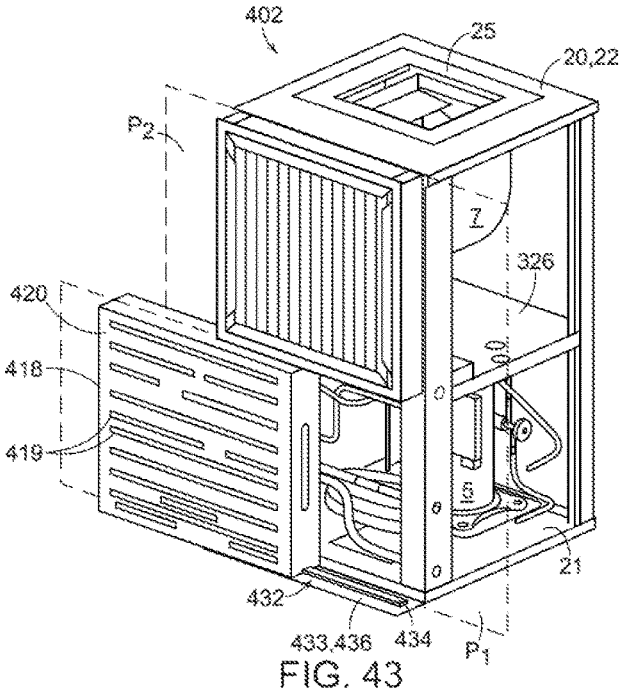
FIG. 43 is a front perspective view of the heat pump of FIG. 41 shown in a left-hand air inlet configuration, with housing sidewalls omitted to show the arrangement of some of the main components of the heat pump within the heat pump housing, and illustrating the e-box in a partially extended position relative to the housing.
Figure 44:
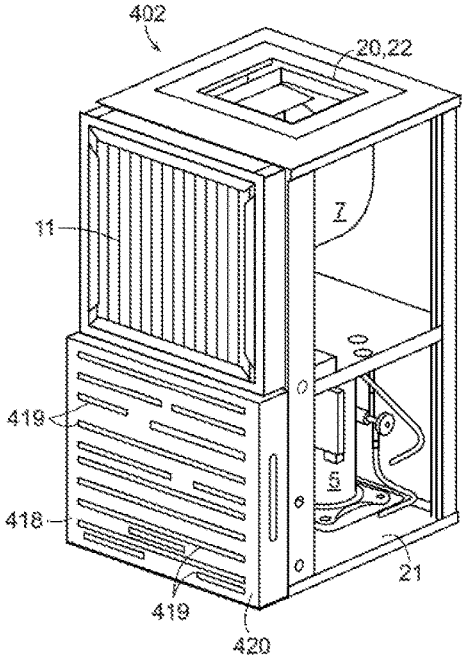
FIG. 44 is the perspective view of the heat pump of FIG. 43 shown with the e-box in a retracted position relative to the housing.
Figure 45:
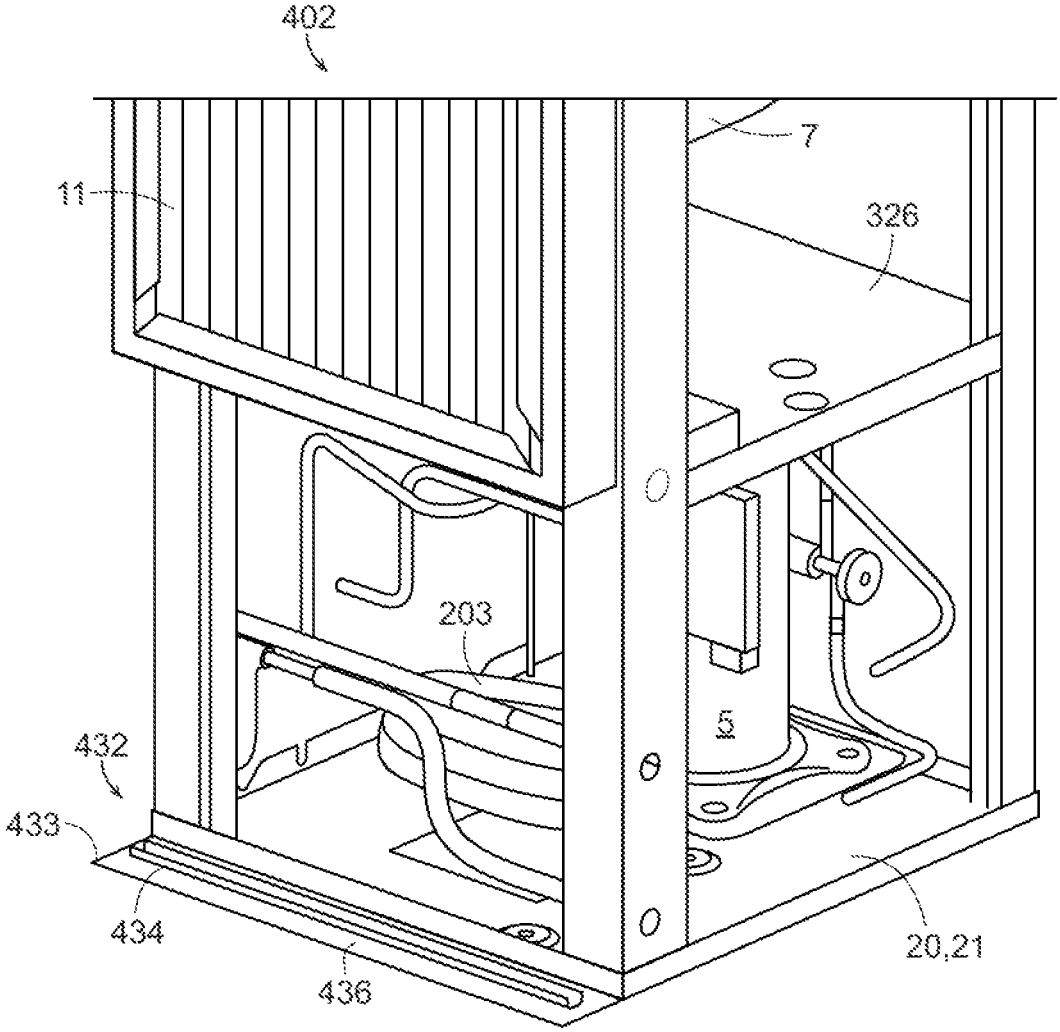
FIG. 45 is the perspective view of the heat pump of FIG. 43 shown with the e-box removed from the housing to permit visualization of the slide mechanism of the e-box.
Figure 46:
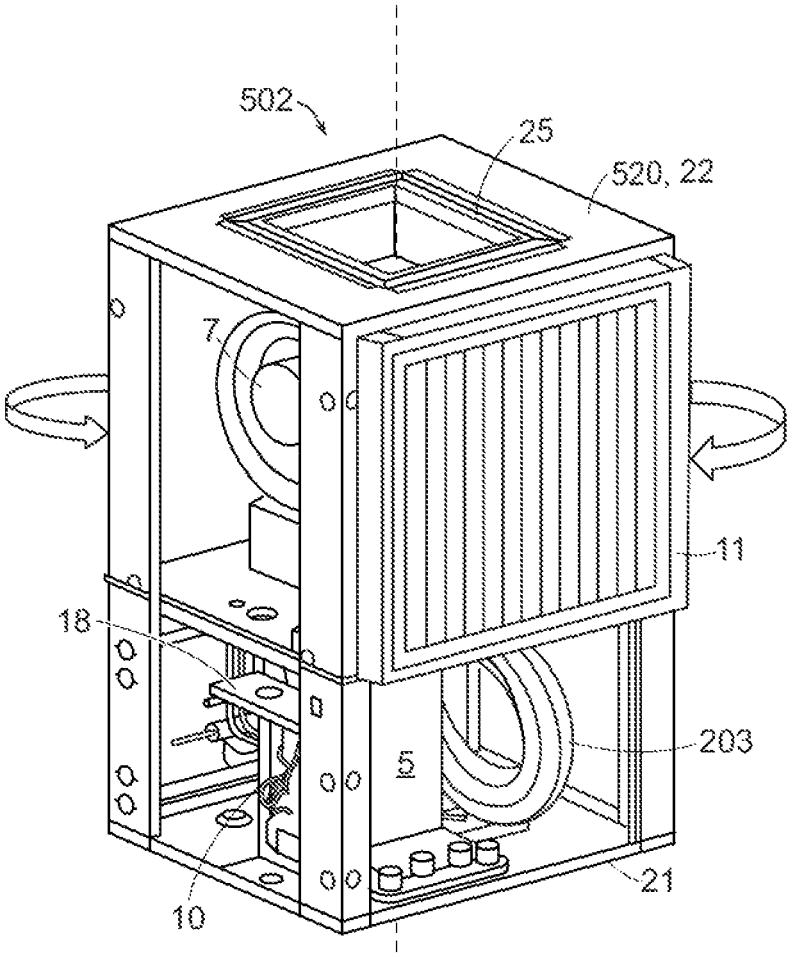
FIG. 46 is a side perspective view of another alternative embodiment heat pump, shown in a right-hand air inlet configuration, with housing sidewalls omitted to show the arrangement of some of the main components of the heat pump within the heat pump housing, and illustrating the e-box fixed within the housing.
Figure 47:
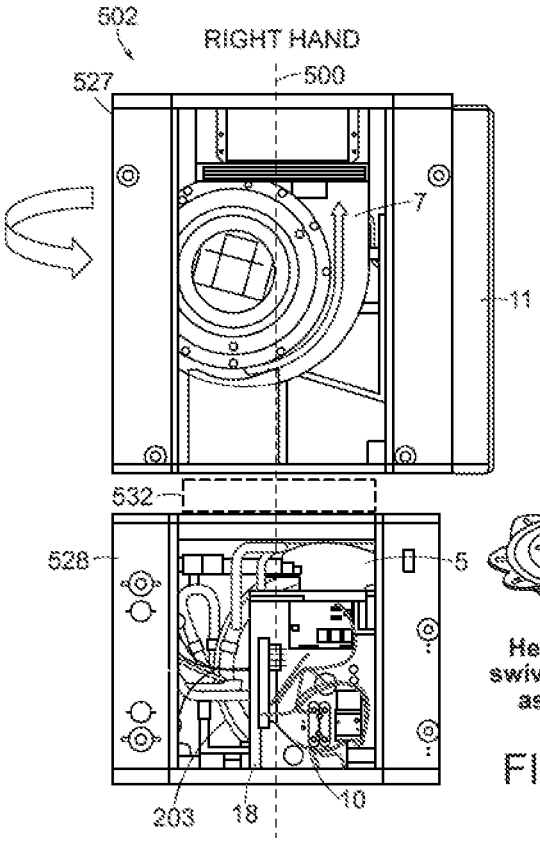
FIG. 47 is an exploded side view of the heat pump of FIG. 46 shown in a right-hand air inlet configuration.
Figure 48:
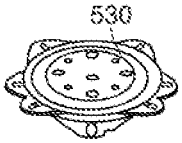
FIG. 48 is a perspective view of an example of a swivel bracket.
Figure 49:
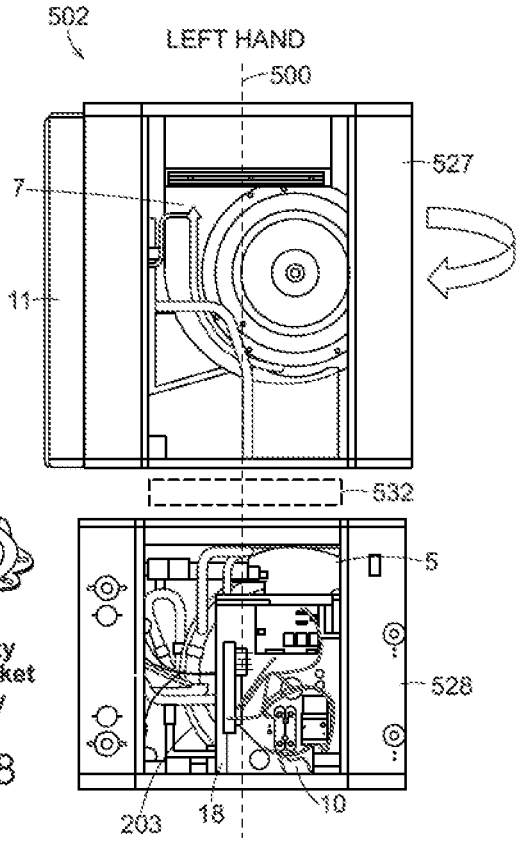
FIG. 49 is an exploded side view of the heat pump of FIG. 46 shown in a left-hand air inlet configuration.
Figure 50:
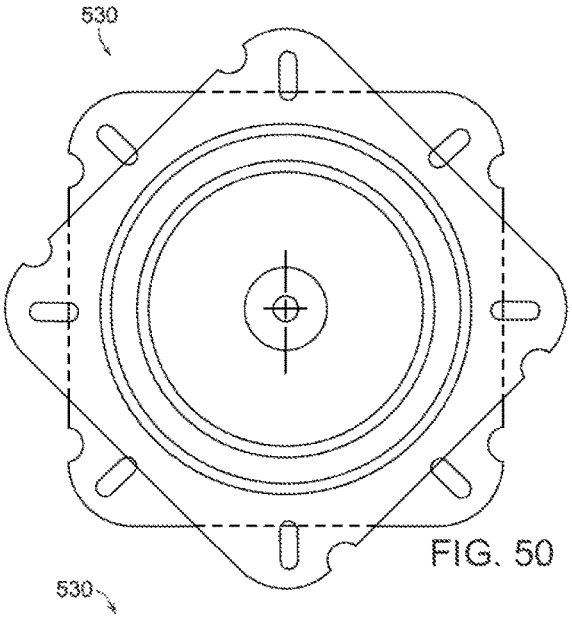
FIG. 50 is a top view of the swivel bracket of FIG. 48.
Figure 51:
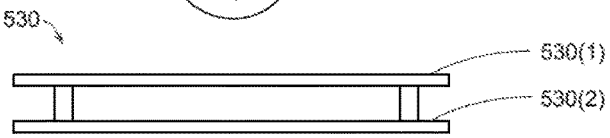
FIG. 51 is a side view of the swivel bracket of FIG. 48.
Figure 52:
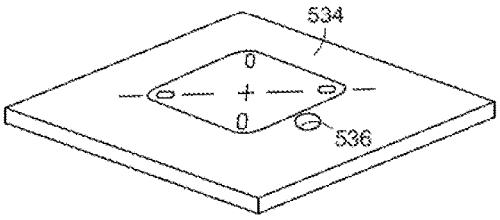
FIG. 52 is a perspective view of a swivel bracket assembly including the swivel bracket of FIG. 48.

Referring to FIG. 32, the water-to-refrigerant heat exchanger 203 is not limited to the specific coil shape described, and may have alternative coil shapes. For example, another embodiment water-to-refrigerant heat exchanger 303 may be arranged so that all coils of the coil stack are parallel or substantially parallel, whereby the first and last coils of the coil stack reside on opposed ends of the coil stack.

Referring to FIGS. 33-40, another alternative embodiment heat pump 302 is similar to the heat pump 2 described above with respect to FIGS. 1-14, and provides at least the same advantages. Elements that are common with the previous embodiments are referred to with common reference numbers. The heat pump 302 differs from the heat pump 2, 102, 202 of the earlier embodiments with respect to how the e-box 18 is supported within the housing 20. In the heat pump 302, the e-box 18 is supported on an upper side of the divider panel 326 (e.g., on the air handler section-facing side of the divider panel 26). In this embodiment, the divider panel 326 is planar (for example, the ramp portion 26(3) is omitted). In addition, the e-box 18 is detachably fixed to the divider panel 326 so that the plane P1 is generally horizontal and is generally perpendicular or substantially perpendicular to the plane P2. In particular, a first set of brackets 360 protrude from the air handler section-facing side of the divider panel 26. The first set of brackets 360 are configured to retain the e-box 18 within the housing 20 in such a way that the e-box 18 is spaced apart from, and resides above, the divider panel 326. In addition, the heat pump 302 includes a second set of brackets 362 that protrude from the condensing section-facing side of the divider panel 26. The second set of brackets 362 are configured to support the e-box 18 in a vertical orientation that overlies a side of the housing 20, for example during servicing the heat pump 302. The second set of brackets 362 is provided on both of opposed sides of the housing 20 to accommodate both the right- and left-hand air inlet configurations. The e-box 18 is supported on the first set of brackets 360 during normal operation of the heat pump 302. During installation, maintenance or service of the heat pump 302, the e-box 18 may be detached from the first brackets 360 and mounted on the second brackets 362 to permit easy access to the control board 10. After completion of the installation and under normal operation, the e-box 18 should remain mounted on the second brackets 362. For maintenance or service, the e-box 18 may be re-mounted to the first set of brackets 360, for easy access to components in the condensing section.

The heat pump 302 differs from the heat pump 2, 102 in that it includes the water-to-refrigerant heat exchanger 203 that is supported on the housing first end 21 in an angled orientation via a support bracket 364. The support bracket 364 supports the water-to-refrigerant heat exchanger 203 in such a way that the coil axis 237 is acutely angled relative to both the housing first end 21 and relative to the second plane P2. For example, the support bracket 364 may be configured to orient the coils at a 20 degree angle relative to the housing first end 21. The water-to-refrigerant heat exchanger 203 is arranged so that the water inlet and outlet 240, 242 reside above the coils and are each at the same distance from the housing first end 21. In addition, the water inlet and outlet 240, 242 are facing a common side of the housing 20. In the illustrated embodiment, the water inlet and outlet 240, 242 face, and are closely adjacent to, the side of the housing 20 that includes the air inlet 24.

The first water inlet 240 is connected to the first port 30(1) disposed in the first corner post 29(1) and the second port 30(2) disposed in the third corner post 29(3) via a first piping section 149 having a T-configuration. Likewise, the first water outlet 242 is connected to the third port 30(3) disposed in the first corner post 29(1) and the fourth port 30(4) disposed in the third corner post 29(3) via a second piping section 150 having a T-configuration. In this embodiment, the first and third corner posts 29(1), 29(3) are on the same side of the housing 20, and bracket the air inlet 24. In addition, the first and second ports 30(1), 30(2) open along a side of the housing 20 that is adjacent to the side that includes the air inlet 24 and the air-to-refrigerant heat exchanger 4, and the third and fourth ports 30(3), 30(4) open along a side of the housing 20 that is opposite to the side that includes the first and second ports 30(1), 30(2).

When the heat pump 302 is in a left-hand air inlet configuration, the first corner post 29(1) is on the front and left corner of the housing 20. In this configuration, the water inlet 240 receives water via the open first port 30(1), and the water outlet 242 discharges water to the open third port 30(3), and the first and third ports 30(1), 30(3) are easily accessible for connection. In addition, the second and fourth ports 30(2), 30(4) are closed, for example by capping or plugging the respective second and fourth ports 30(2), 30(4).

When the heat pump 302 is in a right-hand air inlet configuration, the third corner post 29(3) is on the front and right corner of the housing 20. In this configuration, the water inlet 240 receives water via the open second port 30(2), and the water outlet 242 discharges water to the open fourth port 30(4), and the second and fourth ports 30(2), 30(4) are easily accessible for connection. In addition, the first and third ports 30(1), 30(3) are closed, for example by capping or plugging the respective first and third ports 30(1), 30(3).

Referring to FIGS. 41-45 another alternative embodiment heat pump 402 is similar to the heat pump 2 described above with respect to FIGS. 1-14, and provides at least the same advantages. Elements that are common with the previous embodiments are referred to with common reference numbers. The heat pump 402 differs from the heat pump 2, 102, 202, 302 of the earlier embodiments in that it includes an alternative embodiment e-box 418 that is supported on an outer surface of the housing 20 in such a way the first plane P1 is oriented vertically and is parallel or substantially parallel to plane P2. The e-box 418 is increased in length and width as compared to the earlier embodiments so that the e-box 418 can serve as a portion of the sidewall 23, e.g., as a sidewall panel. In the illustrated embodiment, the e-box 14 is disposed at a location underlying the air filter 11, which typically protrudes outward from a side of the housing 24. Thus, the e-box 418 utilizes the space under the air filter 11, and selves as a removable housing panel in this location.

Since the e-box 418 serves as a housing panel and resides outside the interior space of the housing 20, the available space within the housing 20 becomes greater and the options for internal component layout are increased.

An outward surface of the e-box 418 is provided with vents 419 that permit airflow into the e-box 418, providing cooling for the control board 10 via convection. In the illustrated embodiment, the vents 419 are elongated through holes (slots) that are distributed generally evenly across the entire outward facing surface 420 of the e-box 418, but the vents 419 are not limited to the illustrated configuration.

The e-box 418 is secured to the housing 20 via a slide mechanism 432. For example, the slide mechanism 432 may include a bracket 433 that protrudes outward from the housing 20 and has a planar, horizontal portion 436 that is parallel or substantially parallel to, and coplanar with, the housing first end 21. The bracket 433 includes a rail 434 that protrudes from the upward-facing surface of the horizontal portion 436. The rail 434 engages a groove (not shown) provided in a downward-facing surface of the e-box 418. The rail 434 and groove cooperate to allow the e-box 418 to slide in a direction parallel or substantially parallel to the planes P1 and P2. In addition, the e-box 418 can translate relative to the housing 20 in opposed directions such that the e-box 418 can be moved from either of opposed sides of the housing, and the interior of the housing 20 can be easily accessed regardless of whether the heat pump 2 is in a right- or left-hand air inlet configuration.

The heat pump 402 differs from the heat pump 2, 102 in that it includes the water-to-refrigerant heat exchanger 203 that is supported on the housing first end 21 in an angled orientation via a support bracket 364, as described above with respect to FIGS. 33-40, and also includes the same port arrangement.

Referring to FIGS. 46-53, another alternative embodiment heat pump 502 is similar to the heat pump 2 described above with respect to FIGS. 1-14, and provides at least the same advantages. Elements that are common with the previous embodiments are referred to with common reference numbers. The heat pump 502 differs from the heat pump 2, 102, 202, 302, 402 of the ember embodiments in that the housing 520 includes two separate cabinet portions 527, 528 that are vertically stacked and joined by a heavy-duty swivel bracket assembly 532. In the housing 520, the upper cabinet portion 527 provides the air handler section of the heat pump 502 and includes the air inlet 24, the air outlet 25, the air-to-refrigerant heat exchanger 4, the blower 7, etc., as discussed in previous embodiments. The lower cabinet portion 528 provides the condensing section of the heat pump 502 and includes the water-to-refrigerant heat exchanger 3, the compressor 5, the control board 10, the expansion valve 6, the reversing valve 12, etc., as discussed in previous embodiments. The swivel bracket assembly 532 permits the upper cabinet portion 527 to rotate relative to the lower cabinet portion 528 about a vertical axis 500.

Figure 53:
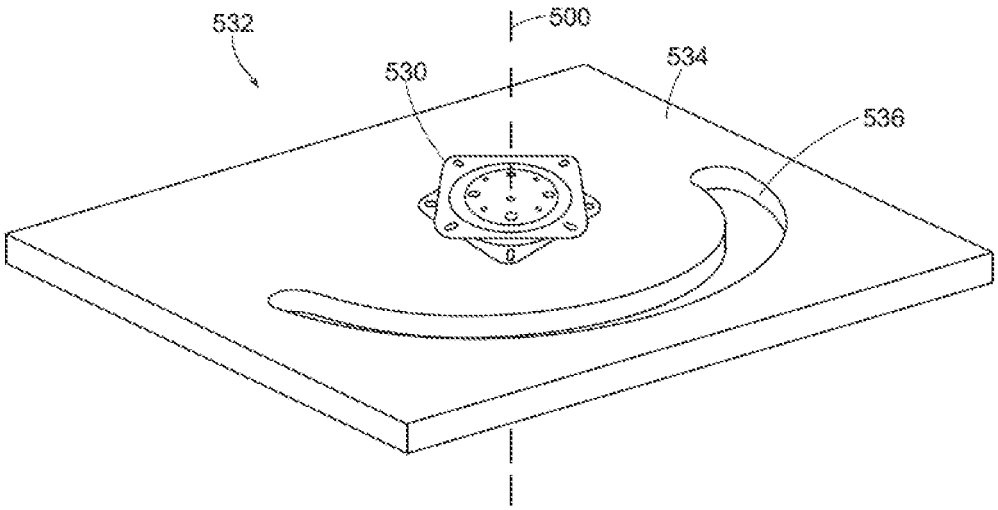
FIG. 53 is a perspective view of the base plate of the swivel bracket assembly of FIG. 48.
Figure 54:
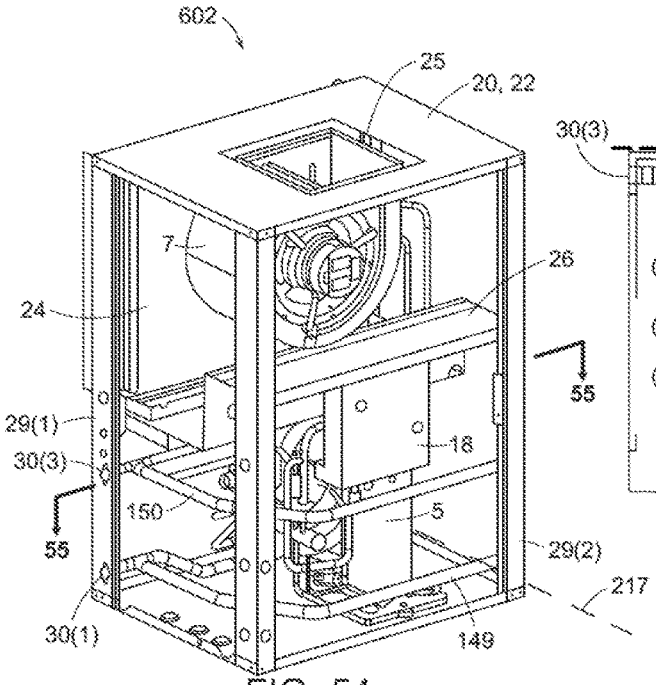
FIG. 54 is a front perspective view of another alternative embodiment heat pump, shown in a left-hand air inlet configuration, with housing sidewalls omitted to show the arrangement of some of the main components of the heat pump within the heat pump housing, and illustrating the e-box in a retracted position relative to the housing.
Figure 55:
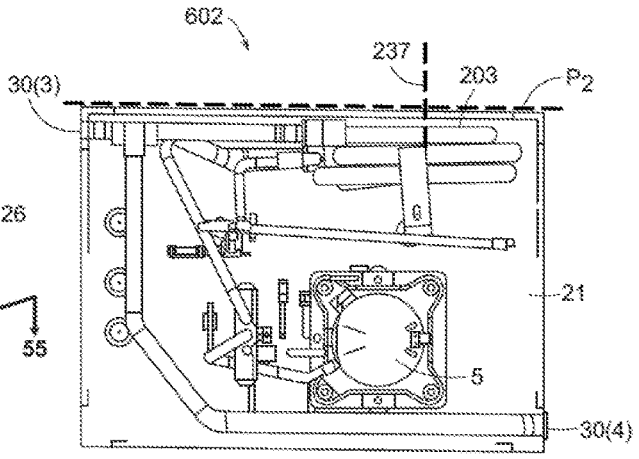
FIG. 55 is a top view of the heat pump of FIG. 54 as seen along line 55-55 of FIG. 54.
Figure 56:
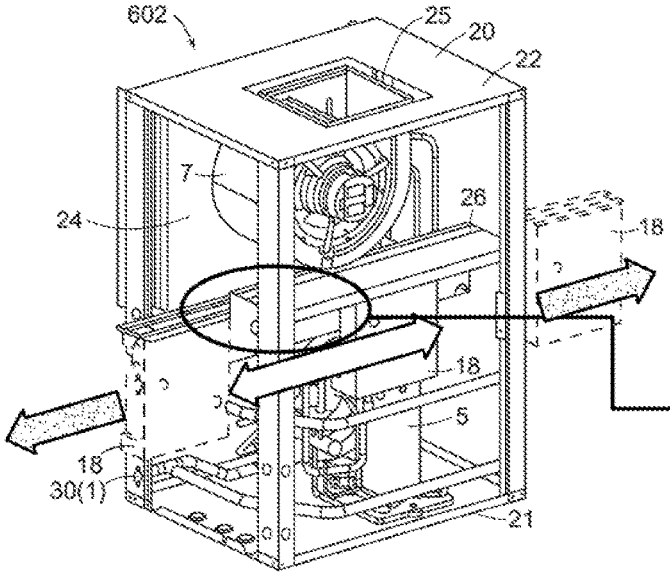
FIG. 56 is a perspective view of the heat pump of FIG. 54 shown with the e-box in extended positions relative to the housing, illustrating that the e-box can be extended out of each of the opposed sides of the housing.
Figure 57:
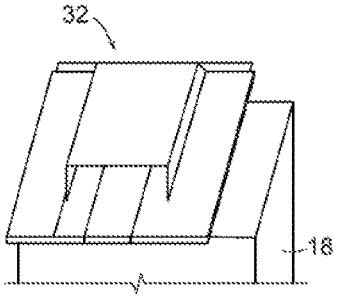
FIG. 57 is a detail view of the encircled portion of FIG. 56 showing an example of a slide mechanism used to connect the e-box to the divider panel.
Figure 58:
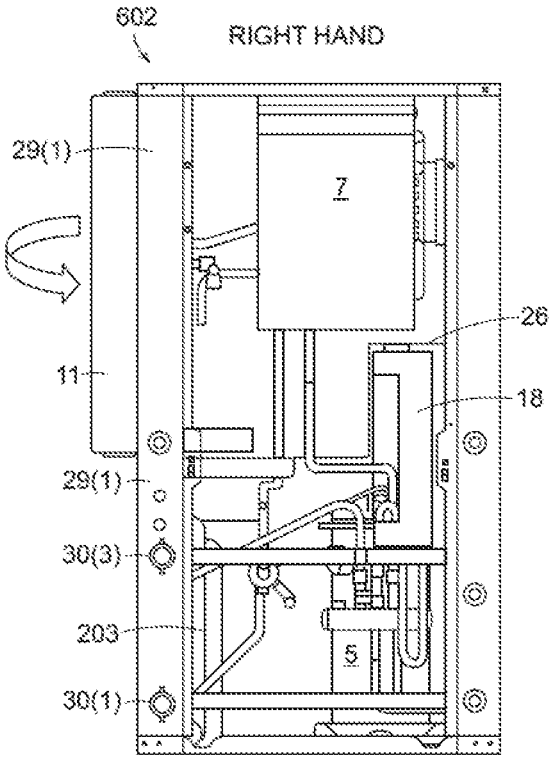
FIG. 58 is a side view of the heat pump of FIG. 54.

The swivel bracket assembly 532 includes a base plate 534 that is supported on an upper surface of the lower cabinet portion 528, and a swivel bracket 530 that is mounted in the center of the base plate 534 and is fixed to a lower surface of the upper cabinet portion 527. In some embodiments, the swivel bracket 530 includes an upper plate 530(1) that is fixed to the upper cabinet portion 527, and a lower plate 530(2) that is fixed to the base plate 534. The upper and lower plates 530(1), 530(2) are relatively rotatable via a bearing system 530(3) that is disposed between, and joins, the upper and lower plates 530(1), 530(2). The base plate 534 may include an access opening 536. The access opening 536 may be a circular through opening (FIG. 52), or alternatively may be an elongate slot that extends along a 180 degree circular arc (FIG. 53). The access opening 536 is dimensioned to receive refrigerant connections that provide the reversible cooling/heating loop 9. In some embodiments, flexible refrigerant connections may be provided between the water-to-refrigerant heat exchanger 4, the reversing valve 12, the expansion valve 6, etc., as needed to accommodate the relative motion of the cabinet portions 527, 528.

The upper cabinet portion 527 may rotate 180 degrees relative to the lower cabinet portion 528, moving the air inlet 24 and water-to-refrigerant heat exchanger 4 from the left side of the housing 520 to the right side of the housing 520. As a result, the left-hand air inlet configuration can be transformed to a right-hand air inlet configuration, and vice-versa.

In some embodiments, a lock mechanism (not shown) is provided that is configured to retain the upper cabinet portion 527 in a desired angular position with respect to the lower cabinet portion 528.

Since the lower cabinet portion 528 is fixed, the water connections and electronics box locations always remain in the same position, regardless of whether the heat pump 502 is in the right-hand air inlet configuration or the left-hand air inlet configuration. As a result, these components may be arranged in any of the above-described configurations or as configured in some conventional heat pumps.

Referring to FIGS. 54-59, another alternative embodiment heat pump 602 is similar to the heat pump 102 described above with respect to FIGS. 15-22, and provides at least the same advantages. Elements that are common with the previous embodiments are referred to with common reference numbers. For example, the heat pump 602 includes the configuration of the e-box 18 in which the e-box 18 is secured to the divider panel 26 rather than the corner posts 29. In particular, the e-box 18 is mounted to the condensing section-facing surface of the divider panel second planar portion 26(2) using the slide mechanism 32. As in the previous embodiment, the e-box 18 is configured to translate relative to the housing 20 via the slide mechanism 32 in a direction that is parallel or substantially parallel to the first plane P1. The slide mechanism 32 permits the e-box 18 to move between a retracted position in which the e-box 18 resides within the condensing section 28 of the housing 20, and an extended position in which the e-box 18 resides outside the housing 20. As shown in FIG. 17, the slide mechanism 32 permits extension with respect to both of opposed sides of the housing 20.

The heat pump 602 differs from the heat pump 102 described with respect to FIGS. 15-22 in that it includes the water-to-refrigerant heat exchanger 203 that is supported on the housing first end 21 in an orientation in which the coil axis 237 is parallel or substantially parallel to the housing first end 21 and perpendicular or substantially perpendicular to the plane P2. The water-to-refrigerant heat exchanger 203 is arranged so that the water inlet and outlet 240, 242 are arranged laterally with respect to the coils such that the water outlet 242 overlies the water inlet 240.

The water inlet 240 is connected to the first port 30(1) disposed in the first corner post 29(1) and the second port 30(2) disposed in the second corner post 29(2) via the first piping section 149 having T-configuration. Likewise, the water outlet 242 is connected to the third port 30(3) disposed in the first corner post 29(1) and the fourth port 30(4) disposed in the second corner post 29(2) via the second piping section 150 having a T-configuration. As in some previous embodiments, the first and second corner posts 29(1), 29(2) are on diagonally opposed corners of the housing 20. In addition, the first and second ports 30(1), 30(2) open along a side of the housing 20 that is adjacent to the side that includes the air inlet 24 and the air-to-refrigerant heat exchanger 4, and the third and fourth ports 30(3), 30(4) open along a side of the housing 20 that is opposite to the side that includes the first and second ports 30(1), 30(2).

When the heat pump 602 is in a left-hand air inlet configuration, the first corner post 29(1) is on the front and left corner of the housing 20. In this configuration, the water inlet 240 receives water via the open first port 30(1), and the water outlet 242 discharges water to the open third port 30(3), and the first and third ports 30(1), 30(3) are easily accessible for connection. In addition, the second and fourth ports 30(2), 30(4) are closed, for example by capping or plugging the respective second and fourth ports 30(2), 30(4).

When the heat pump 602 is in a right-hand air inlet configuration, the second corner post 29(2) is on the front and left corner of the housing 20. In this configuration, the water inlet 240 receives water via the open second port 30(2), and the water outlet 242 discharges water to the open fourth port 30(4), and the second and fourth ports 30(2), 30(4) are easily accessible for connection. In addition, the first and third ports 30(1), 30(3) are closed, for example by capping or plugging the respective first and third ports 30(1), 30(3).

In this embodiment, the water-to-refrigerant heat exchanger 203 is disposed on the housing first end 21 such that the coil axis 237 is parallel or substantially parallel to the housing first end 21, and the compressor 5 is side-by-side with the water-to-refrigerant heat exchanger 203. The vertical configuration of the heat exchanger 203 in combination with positioning the heat exchanger 203 parallel or substantially parallel to and closely adjacent to one side of the sidewall 23, provides more space within the condensing section 28 as compared to some conventional heat exchangers. The additional space can be used to improve accessibility of the internal components and/or accommodating more complex piping structures.

Figure 60:
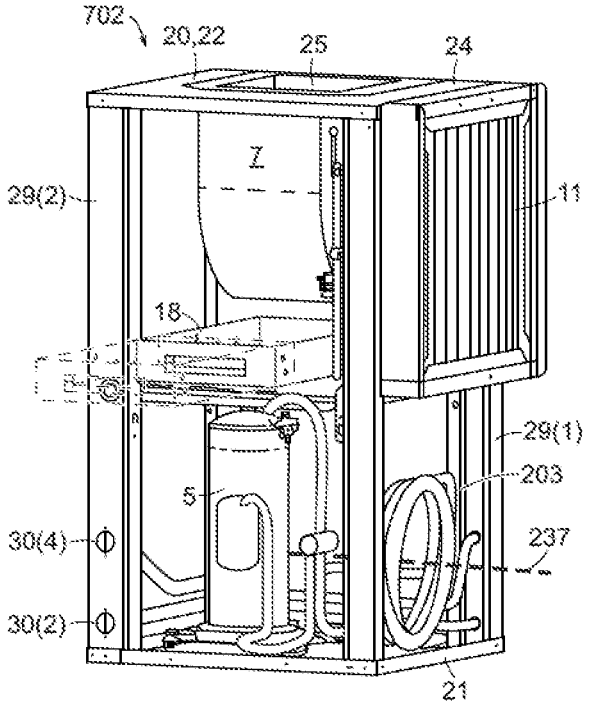
FIG. 60 is a front perspective view of another alternative embodiment heat pump, shown in a right-hand air inlet configuration, with housing sidewalls omitted to show the arrangement of some of the main components of the heat pump within the heat pump housing, and illustrating the e-box in both a retracted position (solid lines) and extended position (broken lines) relative to one side of the housing.
Figure 61:
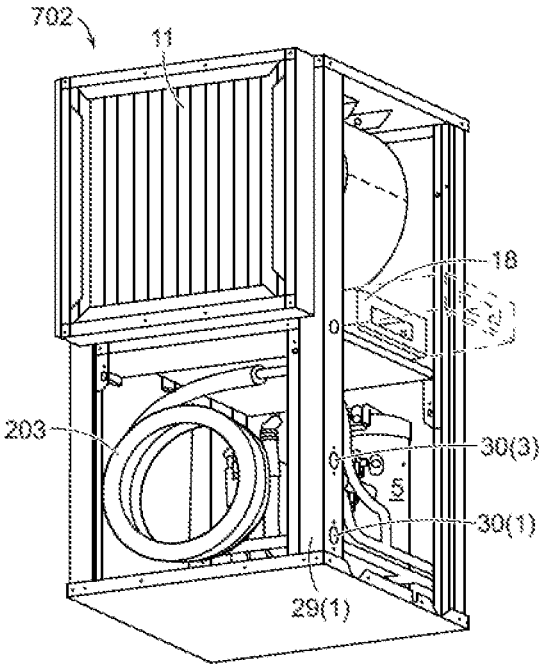
FIG. 61 is a perspective view of the heat pump of FIG. 60 shown in a left-hand air inlet configuration, with housing sidewalls omitted to show the arrangement of some of the main components of the heat pump within the heat pump housing, and illustrating the e-box in both a retracted position (solid lines) and extended position (broken lines) relative to another side of the housing.

Referring to FIGS. 60-61, another alternative embodiment heat pump 702 has features that are similar to those of the heat pumps described in earlier embodiments, and provides at least the same advantages. Elements that are common with the previous embodiments are referred to with common reference numbers. Like the heat pump 202 of FIGS. 23-32, the heat pump 702 includes the configuration of the e-box 18 in which the e-box 18 is secured to the divider panel 326 rather than the corner posts 29. Like the heat pump 302 of FIGS. 33-40, the heat pump 702 includes the planar divider panel 326. In addition, the heat pump 702 includes the e-box 18 mounted to the air handling section-facing surface of the divider panel 326 using the slide mechanism 32 in such a way that the plane P1 is horizontal and the e-box 18 underlies the fan 7. By placing the e-box 18 including the control board 10 in the air-handling section, the electronics housed in the e-box, including the inverter, may be efficiently cooled via convective air flow due to the presence of the fan 7 in the air handler section 27. As in some previous embodiments, the e-box 18 is configured to translate relative to the housing 20 via the slide mechanism 32 in a direction that is parallel or substantially parallel to the first plane P1. The slide mechanism 32 permits the e-box 18 to move between a retracted position (shown in solid lines) in which the e-box 18 resides within the air handler section 27 of the housing 20, and an extended position (shown in broken lines) in which the e-box 18 resides outside the housing 20. The plane P1 is horizontal in both the retracted and extended positions. As shown in FIG. 17 the slide mechanism 32 permits extension with respect to both of opposed sides of the housing 20.

Figure 59:
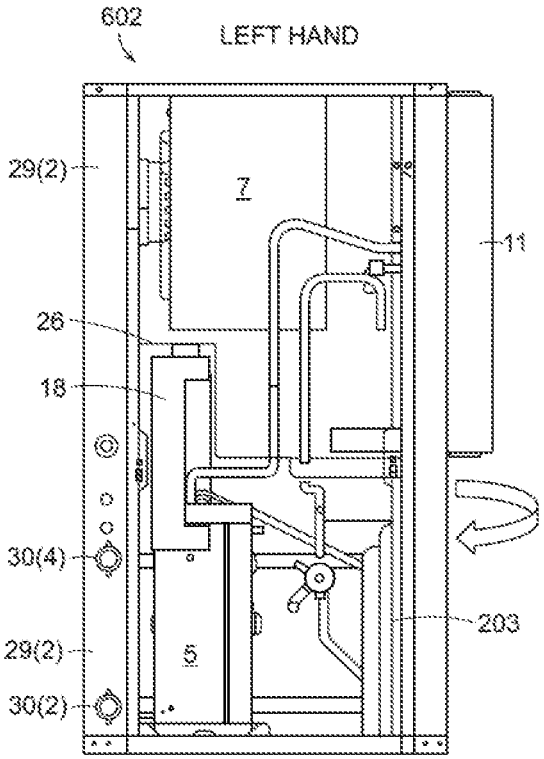
FIG. 59 is a side view of the heat pump of FIG. 54 shown in a right-hand air inlet configuration.
Figure 64:
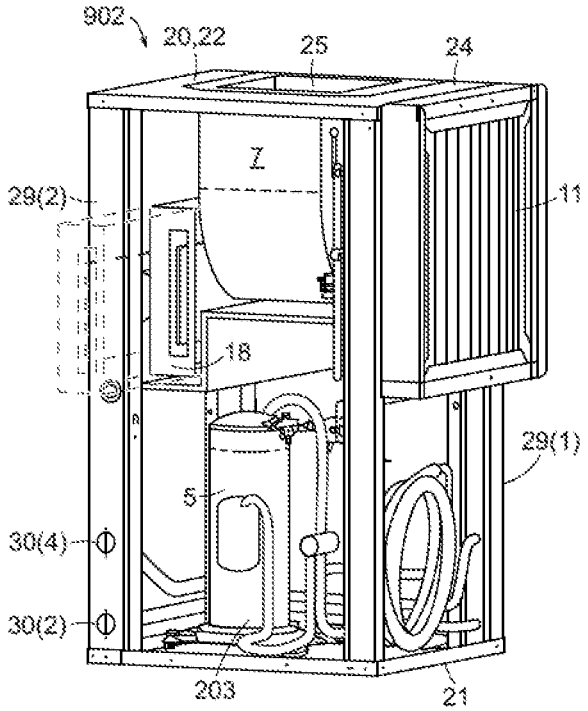
FIG. 64 is a front perspective view of another alternative embodiment heat pump, shown in a right-hand air inlet configuration, with housing sidewalls omitted to show the arrangement of some of the main components of the heat pump within the heat pump housing, and illustrating the e-box in both a retracted position (solid lines) and extended position (broken lines) relative to one side of the housing.

The heat pump 702 is similar to the heat pump 602 described with respect to FIGS. 64-59 in that it includes the water-to-refrigerant heat exchanger 203 that is supported on the housing first end 21 in an orientation in which the coil axis 237 is parallel or substantially parallel to the housing first end 21 and parallel or substantially parallel to the plane P2. The water-to-refrigerant heat exchanger 203 is arranged so that the water inlet and outlet 240, 242 are arranged laterally with respect to the coils such that the water outlet 242 overlies the water inlet 240.

The water inlet 240 is connected to the first port 30(1) disposed in the first corner post 29(1) and the second port 30(2) disposed in the second corner post 29(2) via the first piping section 149 having a T-configuration. Likewise, the water outlet 242 is connected to the third port 30(3) disposed in the first corner post 29(1) and the fourth port 30(4) disposed in the second corner post 29(2) via the second piping section 150 having a T-configuration. As in some previous embodiments, the first and second corner posts 29(1), 29(2) are on diagonally opposed corners of the housing 20. In addition, the first and second ports 30(1), 30(2) open along a side of the housing 20 that is adjacent to the side that includes the air inlet 24 and the air-to-refrigerant heat exchanger 4, and the third and fourth ports 30(3), 30(4) open along a side of the housing 20 that is opposite to the side that includes the first and second ports 30(1), 30(2).

When the heat pump 702 is in a left-hand air inlet configuration, the first corner post 29(1) is on the front and left corner of the housing 20. In this configuration, the water inlet 240 receives water via the open first port 30(1), and the water outlet 242 discharges water to the open third port 30(3), and the first and third ports 30(1), 30(3) are easily accessible for connection. In addition, the second and fourth ports 30(2), 30(4) are closed, for example by capping or plugging the respective second and fourth ports 30(2), 30(4).

When the heat pump 702 is in a right-hand air inlet configuration, the second corner post 29(2) is on the front and left corner of the housing 20. In this configuration, the water inlet 240 receives water via the open second port 30(2), and the water outlet 242 discharges water to the open fourth port 30(4), and the second and fourth ports 30(2), 30(4) are easily accessible for connection. In addition, the first and third ports 30(1), 30(3) are closed, for example by capping or plugging the respective first and third ports 30(1), 30(3).

In this embodiment, the water-to-refrigerant heat exchanger 203 is disposed on the housing first end 21 such that the coil axis 237 is parallel or substantially parallel to the housing first end 21, and the compressor 5 is side-by-side with the water-to-refrigerant heat exchanger 203. The vertical configuration of the heat exchanger 203 in combination with positioning the heat exchanger 203 parallel or substantially parallel to and closely adjacent to one side of the sidewall 23, provides more space within the condensing section 28 as compared to some conventional heat exchangers. The additional space can be used to improve accessibility of the internal components and or accommodating more complex piping structures.

Figure 62:
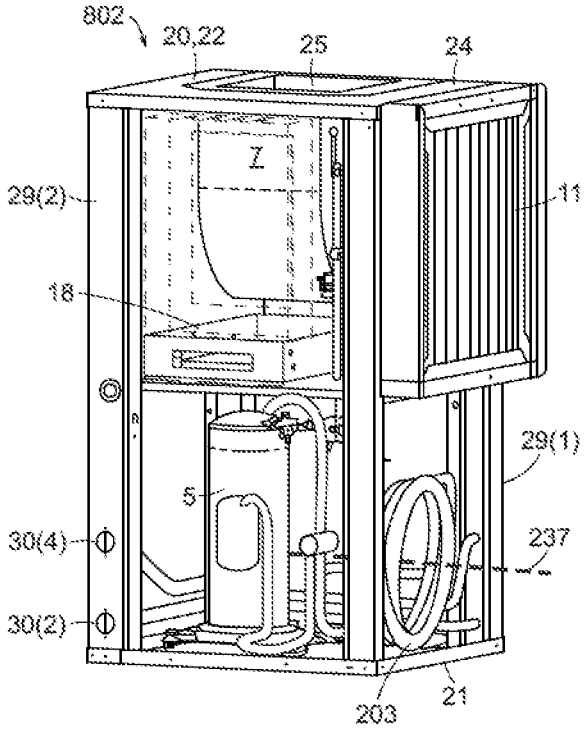
FIG. 62 is a front perspective view of another alternative embodiment heat pump, shown in a right-hand air inlet configuration, with housing sidewalls omitted to show the arrangement of some of the main components of the heat pump within the heat pump housing, and illustrating the e-box in both a retracted position (solid lines) and extended position (broken lines) relative to one side of the housing.
Figure 63:
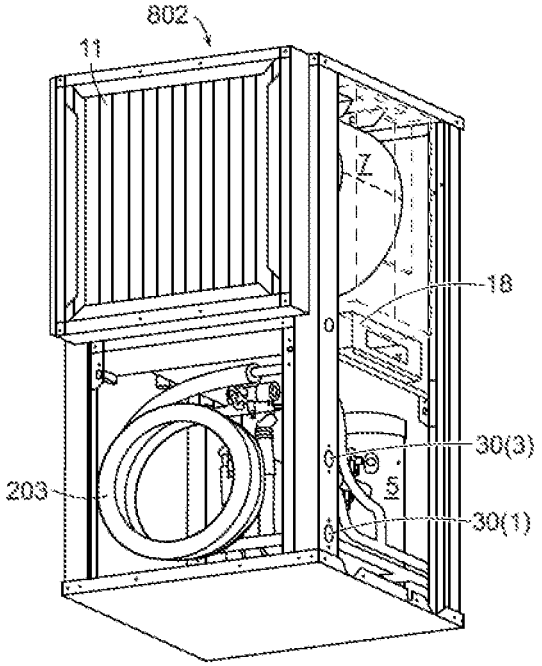
FIG. 63 is a perspective view of the heat pump of FIG. 62 shown in a left-hand air inlet configuration, with housing sidewalls omitted to show the arrangement of some of the main components of the heat pump within the heat pump housing, and illustrating the e-box in both a retracted position (solid lines) and extended position (broken lines) relative to another side of the housing.

Referring to FIGS. 62-63, another alternative embodiment heat pump 802 has features that are similar to those of the heat pumps described in earlier embodiments, and provides at least the same advantages. Elements that are common with the previous embodiments are referred to with common reference numbers. Like the heat pump 202 of FIGS. 23-32, the heat, pump 802 includes the configuration of the e-box 18 in which the e-box 18 is secured to the divider panel 326 rather than the corner posts 29. Like the heat pump 302 of FIGS. 33-40, the heat pump 802 includes the planar divider panel 326. In addition, the heat pump 802 includes the e-box 18 mounted to the air handling section-facing surface of the divider panel 326 using the slide mechanism 32 in such a way that the plane P1 is horizontal and the e-box 18 underlies the fan 7. By placing the e-box 18 including the control board 10 in the air-handling section, the electronics housed in the e-box, including the inverter, may be efficiently cooled via convective air flow due to the presence of the fan 7 in the air handler section 27. As in some previous embodiments, the e-box 18 is configured to translate relative to the housing 20 via the slide mechanism 32 in a direction that is parallel or substantially, parallel to the first plane P1. The slide mechanism 32 permits the e-box 18 to move between a retracted position (shown in solid lines) in which the e-box 18 resides within the air handler section 27 of the housing 20, and an extended position (shown in broken lines) in which the e-box 18 resides outside the housing 20. The heat pump 802 differs from the heat pump 702 illustrated in FIGS. 60-61 in that the heat pump 802, the e-box 18 in the extended position may be mounted along a side of the housing 20 at a location corresponding to the air handler section 27, and oriented so that the plane P1 is vertical and perpendicular or substantially perpendicular to the plane P2. As shown in FIG. 1 the slide mechanism 32 permits extension with respect to both of opposed sides of the housing 20. In the extended position, the e-box 18 may transition to a pair of vertical rails (not shown) or may be detach from the slide mechanism 32 and then hung from brackets (not shown) mounted adjacent the housing second end 22.

The heat pump 802 is similar to the heat pump 702 described with respect to FIGS. 60-61 in that it includes the water-to-refrigerant heat exchanger 203 that is supported on the housing first end 21 in an orientation in which the coil axis 237 is parallel or substantially parallel to the housing first end 21 and parallel or substantially parallel to the plane P2.

Figure 65:
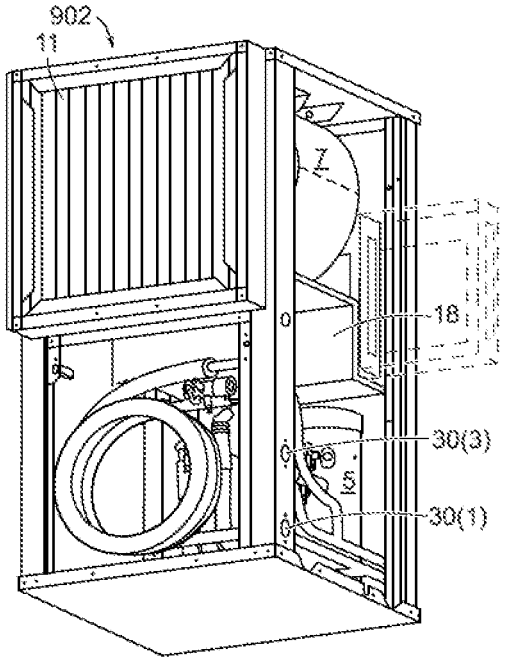
FIG. 65 is a perspective view of the heat pump of FIG. 64 shown in a left-hand air inlet configuration, with housing sidewalls omitted to show the arrangement of some of the main components of the heat pump within the heat pump housing, and illustrating the e-box in both a retracted position (solid lines) and extended position (broken lines) relative to another side of the housing.

Referring to FIGS. 64-65, another alternative embodiment heat pump 902 has features that are similar to those of the heat pumps described in earlier embodiments, and provides at least the same advantages. Elements that are common with the previous embodiments are referred to with common reference numbers. Like the heat pump 102 of FIGS. 15-22, the heat pump 902 includes the configuration of the e-box 18 in which the e-box 18 is secured to the divider panel 326 rather than the corner posts 29. Like the heat pump 302 of FIGS. 33-40, the heat, pump 902 includes the planar divider panel 326. In addition, the heat pump 902 includes the e-box mounted to the air handling section-facing surface of the divider panel 326 using the slide mechanism 32 in such a way that the plane P1 is vertical and the e-box 18 can translate along one side of the fan 7. By placing the e-box 18 including the control board 10 in the air-handling section, the electronics housed in the e-box 18, including the inverter, may be efficiently cooled via convective air flow due to the presence of the fan 7 in the air handler section 27. As in some previous embodiments, the e-box 18 is configured to translate relative to the housing 20 via the slide mechanism 32 in a direction that is parallel or substantially parallel to the first plane P1. The slide mechanism 32 permits the e-box 18 to move between a retracted position (shown in solid lines) in which the e-box 18 resides within the air handler section 27 of the housing 20, and an extended position (shown in broken lines) in which the e-box 18 resides outside the housing 20. The plane P1 is vertical in both the retracted and extended positions. As shown in FIG. 17, the slide mechanism 32 permits extension with respect to both of opposed sides of the housing 20.

The heat pump 902 is similar to the heat pump 702 described with respect to FIGS. 60-61 in that it includes the water-to-refrigerant heat exchanger 203 that is supported on the housing first end 21 in an orientation in which the coil axis 237 is parallel or substantially parallel to the housing first end 21 and parallel or substantially parallel to the plane P2.

Figure 66:
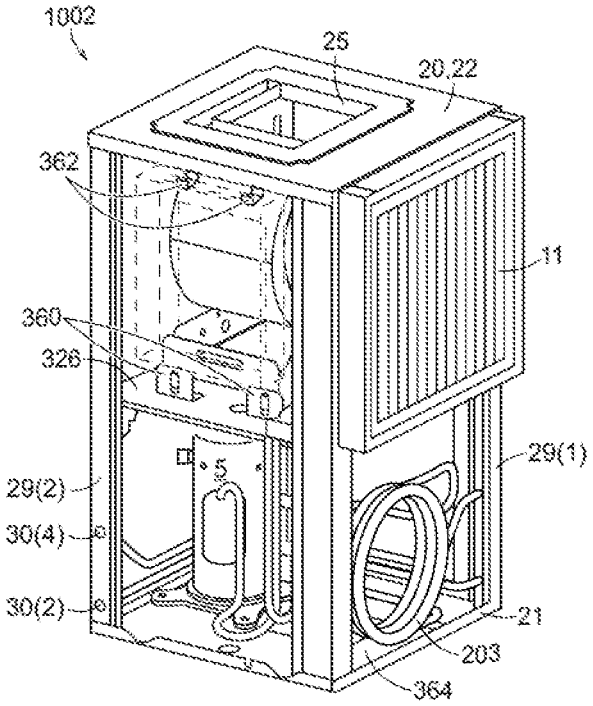
FIG. 66 is a front perspective view of another alternative embodiment heat pump, shown in a right-hand air inlet configuration, with housing sidewalls omitted to show the arrangement of some of the main components of the heat pump within the heat pump housing, and illustrating the e-box in both a retracted position (solid lines) and extended position (broken lines) relative to one side of the housing.
Figure 67:
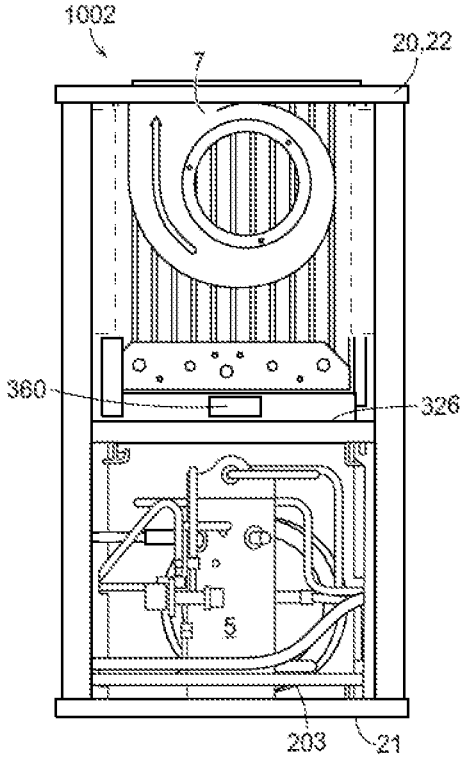
FIG. 67 is a perspective view of the heat pump of FIG. 66 shown in a left-hand air inlet configuration, with housing sidewalls omitted to show the arrangement of some of the main components of the heat pump within the heat pump housing, and illustrating the e-box in both a retracted position (solid lines) and extended position (broken lines) relative to another side of the housing.

Referring to FIGS. 66-67, another alternative embodiment heat pump 1002 has features that are similar to those of the heat pumps described in earlier embodiments, and provides at least the same advantages. Elements that are common with the previous embodiments are referred to with common reference numbers. Like the heat pump 302 of FIGS. 33-40, the heat pump 1002 includes the configuration of the e-box 18 in which the e-box 18 is secured to the planar divider panel 326. In the heat pump 1002, the e-box 18 is supported on an upper side of the divider panel 326 (e.g., on the air handler section-facing side of the divider panel 26). In addition, the e-box 18 is detachably fixed to the divider panel 326 so that the plane P1 is generally horizontal and is perpendicular or substantially perpendicular to the plane P2. In particular, in a retracted position, the e-box 18 is mounted on the first set of brackets 360, which protrude from the air handler section-facing side of the divider panel 326. The first set of brackets 360 are configured to retain the e-box 18 within the housing 20 in such a way that the e-box 18 is spaced apart from, and resides above, the divider panel 326 and underlies the fan 7. In addition, the heat pump 1002 includes a second set of brackets 362 that protrude from the air handler section-facing side of the housing second end 22. The second set of brackets 362 are configured to support the e-box 18 in a vertical orientation that overlies a side of the housing 20. The second set of brackets 362 is provided on both of opposed sides of the housing 20 to accommodate both the right- and left-hand air inlet configurations. The e-box 18 is supported on the first set of brackets 360 during transport of the heat pump 1002. During installation, maintenance or service of the heat pump 1002, the e-box 18 may be detached from the first brackets 360 and mounted on the second brackets 362 to permit easy access to the control board 10. After completion of the installation and under normal operation, the e-box 18 should remain mounted on the second brackets 362.

The heat pump 1002 is similar to the heat pump 702 described with respect to FIGS. 60-61 in that it includes the water-to-refrigerant heat exchanger 203 that is supported on the housing first end 21 in an orientation in which the coil axis 237 is parallel to the housing first end 21 and parallel to the plane P2.

As used herein, the word "substantially" in the phrase "substantially perpendicular" and in the phrase "substantially parallel" refers to the degree of accuracy of measurement of the terms "perpendicular" and "parallel," and indicate that these terms may be largely, but not wholly, that which is specified to reflect, for example, part variations, manufacturing tolerances and/or assembly variations. In some embodiments, the term substantially refers to a structure being within plus or minus ten degrees of parallel and within plus or minus ten degrees of perpendicular. In other embodiments, the term substantially refers to a structure being within plus or minus five degrees of parallel and within plus or minus five degrees of perpendicular. In still other embodiments, the term substantially refers to a structure being within plus or minus three degrees of parallel and within plus or minus three degrees of perpendicular.

Selective illustrative embodiments of the heat pump and insert are described above in some detail. It should be understood that only structures considered necessary for clarifying, the heat pump and insert have been described herein. Other conventional structures, and those of ancillary and auxiliary components of the heat pump and insert, are assumed to be known and understood by those skilled in the art. Moreover, while a working example of the heat pump and insert have been described above, the system, the heat pump and insert are not limited to the working examples described above, but various design alterations may be carried out without departing from the heat pump and insert as set forth in the claims.

What is claimed, is:

1. An environmental control unit comprising:

a housing that includes:

a first end that rests on a support surface;

a second end that is spaced apart from the first end;

a sidewall that extends between the first end and the second end, the sidewall including a first side, a second side, a third side and a fourth side;

an air inlet provided in the first side; and an air outlet provided in the second end, a blower disposed in the housing, the blower configured to draw air into the housing via the air inlet and to exhaust air from the housing via the air outlet;

a first heat exchanger disposed in the housing between the air inlet and the blower;

a second heat exchanger disposed in the housing, the first heat exchanger and the second heat exchanger being connected via a closed-loop line that circulates refrigerant, the second heat exchanger including a first fluid inlet, a first fluid outlet, a second fluid inlet and a second fluid outlet, a compressor disposed in housing, and an expansion valve disposed in the housing, wherein the first fluid inlet is connected to a first port in the second side of the sidewall, the second side adjoining the first side, the first fluid outlet is connected to a second port in the second side, the second fluid inlet is connected to a third port in the third side of the sidewall, the third side adjoining the first side and being disposed opposite to the second side, the second fluid outlet is connected to a fourth port in the third side, the environmental control unit can be configured in a first configuration in which the first side including faces a first direction and a second configuration in which the first side faces a second direction, the first direction is opposite the second direction, when the environmental control unit is configured in the first configuration, the first fluid inlet and the first fluid outlet are open, and the second fluid inlet and the second fluid outlet are closed, and when the environmental control unit is configured in the second configuration, the first fluid inlet and the first fluid outlet are closed, and the second fluid inlet and the second fluid outlet are open.

2. The environmental control unit of claim 1, comprising an e-box and a control board that is disposed in the e-box, a broad surface of the control board residing in a first plane, wherein the e-box is configured to be moved between a retracted position in which the e-box is disposed in the housing, and first or second extended positions that are different from the retracted position and in which the control board is accessible from outside the housing, the first extended position being disposed on the sidewall second side, and the second extended position being disposed on the sidewall third side, the sidewall third side being opposite the sidewall second side.

3. The environmental control unit of claim 2, wherein when the e-box is in the first or second extended position, the e-box is disposed outside the housing.

4. The environmental control unit of claim 2, wherein the e-box is movable between the retracted position and the first or second extended position via a slide mechanism.

5. The environmental control unit of claim 2, wherein when the e-box is in the retracted position, the e-box is supported on a first set of brackets, when the e-box is in the first or second extended position, the e-box is supported on a second set of brackets, and the e-box is detached from the housing when being moved between the retracted position and the first or second extended position.

6. The environmental control unit of claim 2, wherein when the e-box is in the retracted position, the first plane is parallel to the housing first end, and when the e-box is in the first or second extended position the first plane is parallel to the housing first end.

7. The environmental control unit of claim 2, wherein when the e-box is in the retracted position, the first plane is parallel to the housing first end, and when the e-box is in the first or second extended position the first plane is angled relative to the housing first end.

8. The environmental control unit of claim 2, comprising a divider panel that segregates an interior space of the housing into an air handler section that includes the blower and a condensing section that includes the condenser, wherein when the e-box is in the retracted position, the e-box is disposed in the air handler section.

9. The environmental control unit of claim 2, comprising a divider panel that segregates an interior space of the housing into an air handler section that includes the blower and a condensing section that includes the condenser, wherein when the e-box is in the retracted position, the e-box is disposed in the condensing section.

10. The environmental control unit of claim 1, wherein the blower and the e-box are disposed in a common compartment of the environmental control unit, and the e-box is cooled via convective air flow generated by the blower.

11. The environmental control unit of claim 1, wherein
the second heat exchanger is arranged in a coil that is centered on, and surrounds, a coil axis,
the second heat exchanger is disposed in the housing adjacent to the housing first end, and
the second heat exchanger is oriented within the housing so that the coil axis is substantially perpendicular to the housing first end.

12. The environmental control unit of claim 11, wherein the compressor is disposed on the housing first end and is surrounded by the second heat exchanger.

13. The environmental control unit of claim 1, wherein
the second heat exchanger is arranged in a coil that is centered on, and surrounds, a coil axis,
the second heat exchanger is disposed in the housing so as to be closer to the housing first end than the housing second end, and
the second heat exchanger is oriented within the housing so that the coil axis is a) parallel to the housing first end, and b) acutely angled relative to a plane defined by the housing air inlet.

14. The environmental control unit of claim 1, wherein
the second heat exchanger is arranged in a coil that is centered on, and surrounds, a coil axis,
the second heat exchanger is disposed in the housing so as to be closer to the housing first end than the housing second end, and
the second heat exchanger is oriented within the housing so that the coil axis is a) parallel to the housing first end, and b) substantially parallel to a plane defined by the housing air inlet.

15. An environmental control unit comprising:
a housing that includes:
a first end that rests on a support surface;
a second end that is spaced apart from the first end;
a sidewall that extends between the first end and the second end, the sidewall including a first side, a second side, a third side and a fourth side;
an air inlet provided in the first side; and
an air outlet provided in the second end,
a blower disposed in the housing, the blower configured to draw air into the housing via the air inlet and to exhaust air from the housing via the air outlet;
a first heat exchanger disposed in the housing between the air inlet and the blower;
a second heat exchanger disposed in the housing, the first heat exchanger and the second heat exchanger being connected via a closed-loop line that circulates refrigerant,
a compressor disposed in housing,
an expansion valve disposed in the housing, and
an e-box and a control board that is disposed in the e-box, a broad surface of the control board residing in a first plane,
wherein
the e-box is configured to be moved between a retracted position in which the e-box is disposed in the housing, and first or second extended positions that are different from the retracted position and in which the control board is accessible from outside the housing,
the first extended position being disposed on the sidewall second side, and
the second extended position being disposed on the sidewall third side, the sidewall third side being opposite the sidewall second side.

16. The environmental control unit of claim 15, wherein when the e-box is in the first or second extended position, the e-box is disposed outside the housing.

17. The environmental control unit of claim 15, wherein the e-box is movable between the retracted position and the first or second extended position via a slide mechanism.

18. The environmental control unit of claim 15, wherein
when the e-box is in the retracted position, the e-box is supported on a first set of brackets,
when the e-box is in the first or second extended position, the e-box is supported on a second set of brackets, and
the e-box is detached from the housing when being moved between the retracted position and the first or second extended position.

19. The environmental control unit of claim 15, wherein when the e-box is in the retracted position, the first plane is parallel to the housing first end, and when the e-box is in the first or second extended position the first plane is angled relative to the housing first end.

20. The environmental control unit of claim 15, wherein when the e-box is in the retracted position, the first plane is perpendicular to the housing first end, and when the e-box is in the first or second extended position the first plane is angled relative to the housing first end.

21. The environmental control unit of claim 15, comprising a divider panel that segregates an interior space of the housing into an air handler section that includes the blower and a condensing section that includes the condenser, wherein when the e-box is in the retracted position, the e-box is disposed in the air handler section.

22. The environmental control unit of claim 15, wherein
the second heat exchanger is arranged in a coil that is centered on, and surrounds, a coil axis,
the second heat exchanger is disposed in the housing adjacent to the housing first end, and
the second heat exchanger is oriented within the housing so that the coil axis is substantially perpendicular to the housing first end.

23. The environmental control unit of claim 15, wherein
the second heat exchanger includes a first fluid inlet, a first fluid outlet, a second fluid inlet and a second fluid outlet,
the first fluid inlet is connected to a first port in the second side of the sidewall, the second side adjoining the first side,
the first fluid outlet is connected to a second port in the second side,
the second fluid inlet is connected to a third port in the third side of the sidewall, the third side adjoining the first side and being disposed opposite to the second side,
the second fluid outlet is connected to a fourth port in the third side,
the environmental control unit can be configured in a first configuration in which the first side including faces a first direction and a second configuration in which the first side faces a second direction,
the first direction is opposite the second direction,
when the environmental control unit is configured in the first configuration, the first fluid inlet and the first fluid outlet are open, and the second fluid inlet and the second fluid outlet are closed, and when the environmental control unit is configured in the second configuration, the first fluid inlet and the first fluid outlet are closed, and the second fluid inlet and the second fluid outlet are open.

* * * * *